US011666129B2

(12) United States Patent
Hawkins

(10) Patent No.: US 11,666,129 B2
(45) Date of Patent: Jun. 6, 2023

(54) QUICK-RELEASE MOUNTING SYSTEM

(71) Applicant: David Robert L. Hawkins, St. Thomas (CA)

(72) Inventor: David Robert L. Hawkins, St. Thomas (CA)

( * ) Notice: Subject to any disclaimer, the term of this patent is extended or adjusted under 35 U.S.C. 154(b) by 106 days.

(21) Appl. No.: 17/174,406

(22) Filed: Feb. 12, 2021

(65) Prior Publication Data

US 2021/0244149 A1 Aug. 12, 2021

Related U.S. Application Data

(60) Provisional application No. 62/975,615, filed on Feb. 12, 2020.

(51) Int. Cl.

| | |
|---|---|
| ***A45C 13/02*** | (2006.01) |
| ***A45C 13/10*** | (2006.01) |
| ***A45F 3/00*** | (2006.01) |

(52) U.S. Cl.

CPC ..... *A45C 13/02* (2013.01); *A45C 13/1069* (2013.01); *A45C 2013/026* (2013.01); *A45C 2013/1015* (2013.01); *A45F 2003/003* (2013.01); *A45F 2200/0591* (2013.01)

(58) Field of Classification Search

CPC ..... A45C 13/02; A45C 13/1068; A45C 2013/026; A45C 2013/1015; A45F 2003/003; A45F 2200/0591

See application file for complete search history.

(56) References Cited

U.S. PATENT DOCUMENTS

| | | | | |
|---|---|---|---|---|
| 6,550,653 | B2 * | 4/2003 | Matthews | A45F 3/14 224/264 |
| 9,243,867 | B2 * | 1/2016 | Ponder | F41C 33/007 |
| 2006/0180624 | A1 * | 8/2006 | Sadow | A45C 7/009 224/582 |
| 2013/0193179 | A1 * | 8/2013 | Davidson | B60R 7/043 224/584 |
| 2016/0367021 | A1 * | 12/2016 | Moreau | A45F 3/00 |

* cited by examiner

*Primary Examiner* — Tri M Mai

(74) *Attorney, Agent, or Firm* — Eduardo Krupnik

(57) ABSTRACT

A quick-release rifle mounting system, comprising: (a) a mounting panel having a back side for securely engaging to an interior surface of a bag, and a front side having at least two panel loops extending therefrom, whereby each panel loop forms an open channel between the panel loop and the front side of the mounting panel; and (b) a quick-release strap has a grip portion and two strap portions, each strap portion having an end attached to the grip portion, and a free end sized to be threaded through the channels on the front side of the mounting panel. The strap portions are releasably attached at their ends to form strap loops.

11 Claims, 28 Drawing Sheets

QUICK-RELEASE MOUNTING SYSTEM

CROSS-REFERENCE TO RELATED APPLICATIONS

This application claims the benefit of provisional patent application Ser. No. 62/975,615, filed 12 Feb. 2020, the contents of which are incorporated herein by reference.

FIELD OF INVENTION

The present invention relates to mounting systems, more particularly to a quick-release firearm mounting system.

BACKGROUND

Strap-type attachment systems for securing equipment are highly versatile and secure. Various equipment is secured by way of strap-type attachment systems, including the well-known Pouch Attachment Ladder System ("PALS").

Firearms, such as a rifle, may be secured on a mounting surface, such as a vest or the interior of a backpack. For example, it may be desirable to secure a firearm, such as a rifle with a foldable stock within a backpack. When securing equipment, such as a firearm, in this way, it may also be desirable to provide for the quick-release of the firearm from the mounting surface.

Accordingly, there is a need for a strap-type attachment system for securing equipment that provides for quick-release of the equipment from the mounting surface.

SUMMARY OF THE INVENTION

A quick-release mounting system, according to the present invention, is a device for securing equipment to a mounting surface of a bag by way of a strap. In one variant, the equipment is a firearm.

In one embodiment, the present invention is a quick-release firearm mounting system, including: (a) a mounting panel having a back side for securely engaging to an interior surface of a bag, and a front side having at least two panel loops extending therefrom, whereby each panel loop forms an open channel between the panel loop and the front side of the mounting panel; and (b) a quick-release strap has a grip portion and two strap portions, each strap portion having an end attached to the grip portion, and a free end sized to be threaded through the channels on the front side of the mounting panel. The strap portions are releasably attached at their ends to form strap loops.

One embodiment has a mounting panel and a quick-release strap. The mounting panel has a back side and a front side. The back side engages with a mounting surface of an interior of a bag and secures the panel thereto to the interior surface of the bag. The front side has at least two panel loops extending therefrom, whereby each panel loop forms an open channel between the panel loop and the mounting panel. The quick-release strap has a grip portion and two strap portions attached thereto. The strap portions are releasably attached at their ends to form strap loops.

The mounting panel is secured to the mounting surface and the strap portions of the quick-release strap are threaded through the channels on the front side of the mounting panel. An item such as a rifle is positioned against the front side of the mounting panel and the strap portions are attached at their ends to form strap loops around the rifle, thereby securing it in place.

In another embodiment of the quick-release firearm mounting system channel inserts are provided that prevent binding and reduce the frictional forces between the strap portions and the channels.

In another embodiment of the quick-release firearm mounting system, each mounting panel further includes one or more strips of webbing attached to the front side at multiple locations, and wherein the one or more panel loops are defined between the points of attachment of the strips of webbing at the multiple locations.

In another embodiment of the quick-release firearm mounting system, the grip portion has a handle.

In another embodiment of the quick-release firearm mounting system, the quick release strap further includes a link strap releasably coupled to the grip portion, the link strap having adjustable means to manipulate the length of the quick-release strap.

In another embodiment of the quick-release firearm mounting system, the system further comprises the bag.

In another embodiment of the quick-release firearm mounting system, the bag comprises a front panel, a back panel opposite to the front panel, a first top wall portion extending from a top edge of the front panel, a second top wall portion extending from a top edge of the back panel, first lateral walls extending from lateral sides of the front panel, second lateral walls extending from lateral sides of the back panel, and a bottom wall extending from a bottom side of the front panel to a bottom side of the back panel, the first top wall portion being adapted to connect with the second top wall portion to form the top wall and the first lateral walls being adapted to connect with the second lateral walls to form side walls, the front panel, back panel, the top wall, the side walls and the bottom wall define a bag interior which includes an interior surface adapted for engaging with the back side of the mounting panel.

In another embodiment of the quick-release firearm mounting system, the bag further comprises a top flap that extends from a top side of the front panel, the top flap being sized to overlap the top wall, the top flap having a top flap opening that aligns with a top wall opening to form that allows the grip portion to slide through such that the grip portion serves as a handle for the bag.

In another embodiment of the quick-release firearm mounting system, the top flap includes one or more magnets that cooperate with corresponding one or more magnets located on the first top wall portion or the second top wall portion to close the top of the bag's top.

In another embodiment of the quick-release firearm mounting system, the bag further comprises lateral flaps extending from the lateral sides of the front panel and that overlap the first and second lateral walls.

In another embodiment of the quick-release firearm mounting system, the lateral flaps include one or more magnets that cooperate with corresponding one or more magnets on the lateral walls.

BRIEF DESCRIPTION OF THE DRAWINGS

In order that the invention may be more clearly understood, a preferred embodiment thereof will now be described in detail by way of example, with reference to the accompanying drawings, in which.

DESCRIPTION OF THE PREFERRED EMBODIMENT

Definitions

Figure 1:
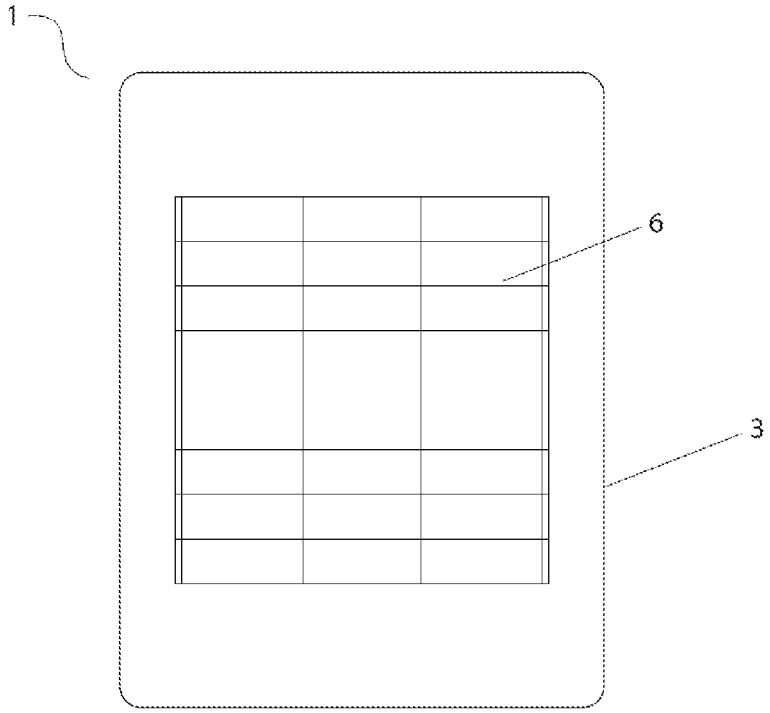
FIG. 1. Front view of a mounting panel, according to the present invention.

Unless defined otherwise, all technical and scientific terms used herein have the same meaning as commonly understood by one of ordinary skill in the art to which this invention belongs. Also, unless indicated otherwise, except within the claims, the use of "or" includes "and" and vice versa. Non-limiting terms are not to be construed as limiting unless expressly stated or the context clearly indicates otherwise (for example "including", "having" and "comprising" typically indicate "including without limitation"). Singular forms included in the claims such as "a", "an" and "the" include the plural reference unless expressly stated otherwise. All relevant references, including patents, patent applications; government publications, government regulations, and academic literature, and including the priority document, are hereinafter detailed and incorporated by reference in their entireties.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

As used herein, the term "substantially" includes exactly the term it modifies and slight variations therefrom.

In this document, the term "firearm" is used to refer to any firearm, including rifles, handguns, or a gun fired from shoulder level, or machine guns.

Overview

The present invention describes a quick-release rifle mounting system, for securing equipment to a mounting surface of a bag by way of a strap. The bag could be any carrier, container or sack suitable for carrying by a user. Examples of bags include, without limitation, backpacks, shoulder bags, and handbags.

To illustrate and describe a preferred embodiment of the quick release mounting system, according to the present invention, the example of a rifle attached to a backpack and of a rifle attached to a shoulder bag will be used.

In brief, with reference to the figures, a quick-release strap 5 is anchored or releasably attached to a mounting panel 1 and serves to releasably secure a rifle to the mounting panel 1. In turn, the mounting panel 1 is anchored or releasably attached to a mounting surface, such as the interior of a bag or backpack. In this way, a properly secured rifle is carried in the bag or backpack by a person who can quickly and easily access the rifle by grasping and pulling the quick-release strap 5 to thereby release the rifle from its securement on the mounting panel 1 and backpack.

Quick Release Assembly

Mounting Panel

Figure 11:
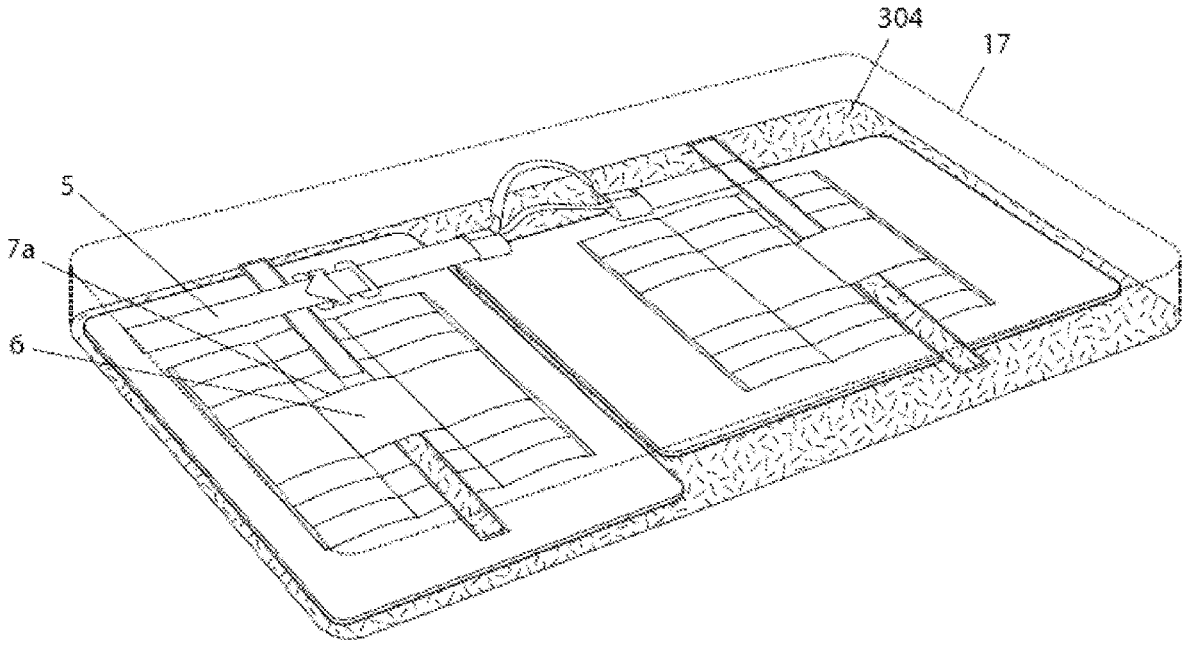
FIG. 11. Perspective view of quick release strap coupled to the mounting strap panels inside a container according to the present invention.
Figure 12A:
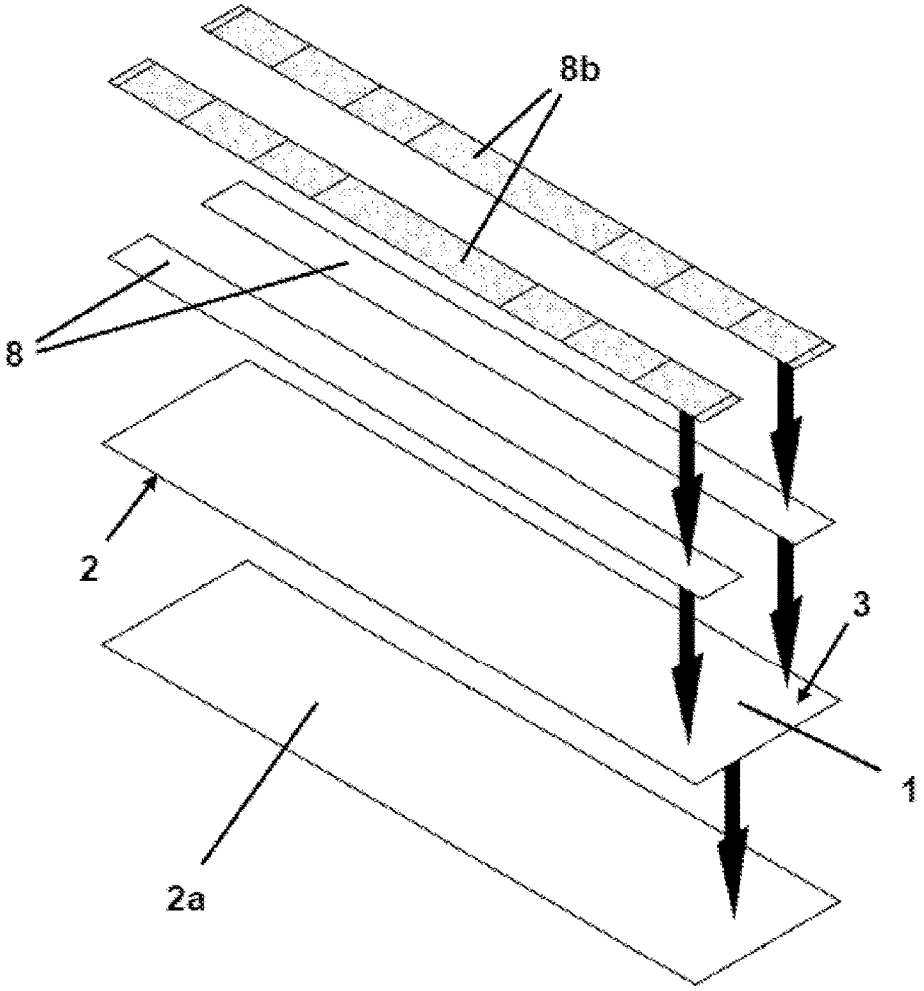
FIG. 12A is an exploded view of the mounting panel, according to the present invention.
Figure 13:
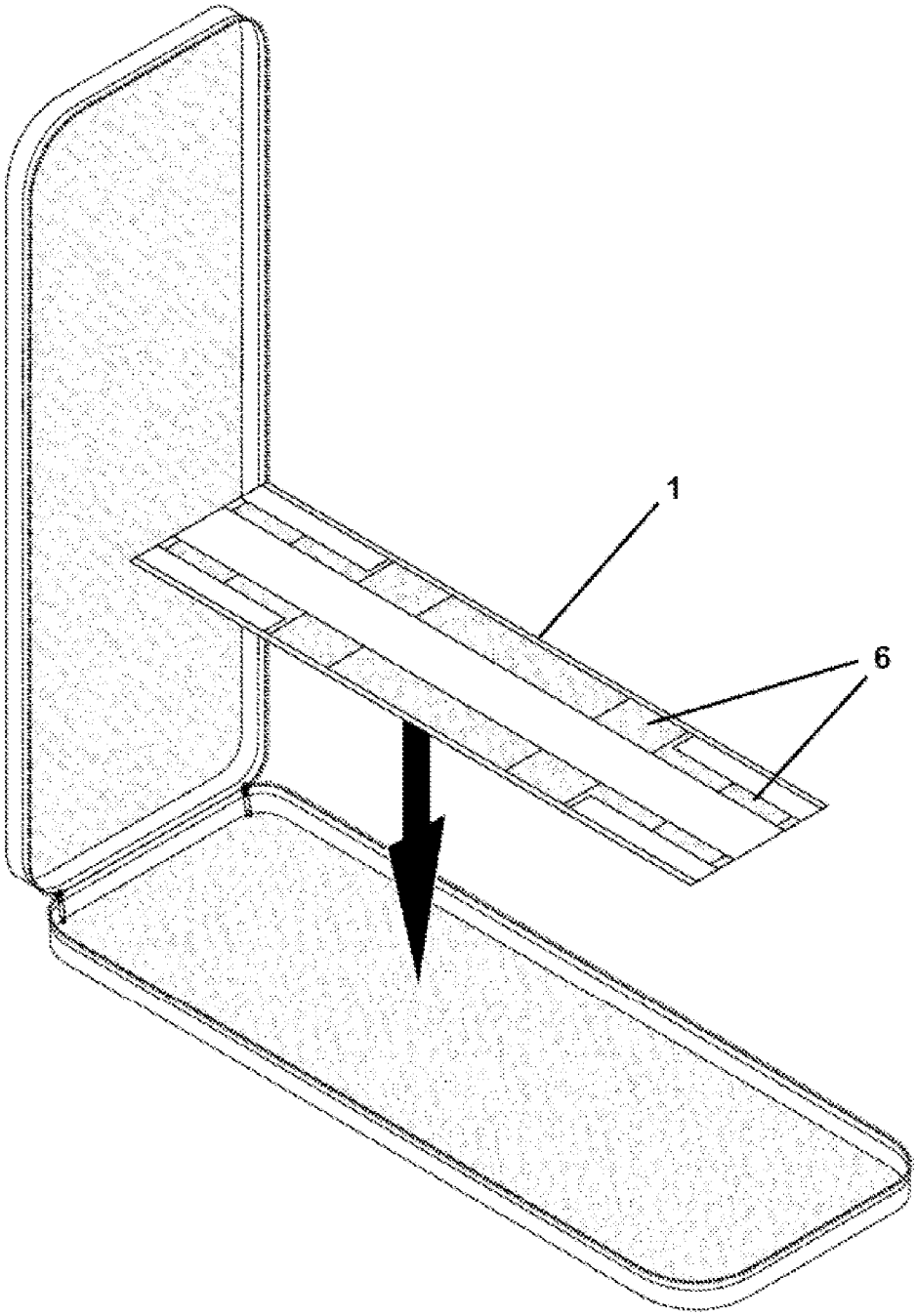
FIG. 13 is a perspective view of one embodiment of the mounting panel engaging with a mounting surface.

As shown in FIGS. 1 to 4 and FIG. 12A, the mounting panel 1 is a sheet-like structure with opposing back and front sides 2 and 3. Preferably, the mounting panel 1 is made from a rectangular sheet of durable nylon material, such as CORDURA™ fabric, but other durable materials may also be used. The mounting panel 1 is an intermediate structure that engages through a mounting surface on the back side 2 to an interior surface of a bag/backpack, and engages with a quick-release strap 5 on the front side 3, as described below. Optionally, the mounting panel 1 may be provided with stabilizers or supports (not shown) to provide a rigid shape to the mounting panel 1. In one embodiment, the mounting panel may be one sheet, as illustrated in FIG. 13. In one embodiment, the mounting panel may be one, two or more subpanels, as shown, for example, in FIGS. 11 and 26. The subpanels and panels of the present invention may be used with a shoulder or hand bag or with a backpack. The advantage of having two or more subpanels is that they can be distributed inside the bag to suit different interior sizes of the bag, or different rifle sizes, or different positions of the rifle within the bag (diagonally or horizontally).

Figure 2:
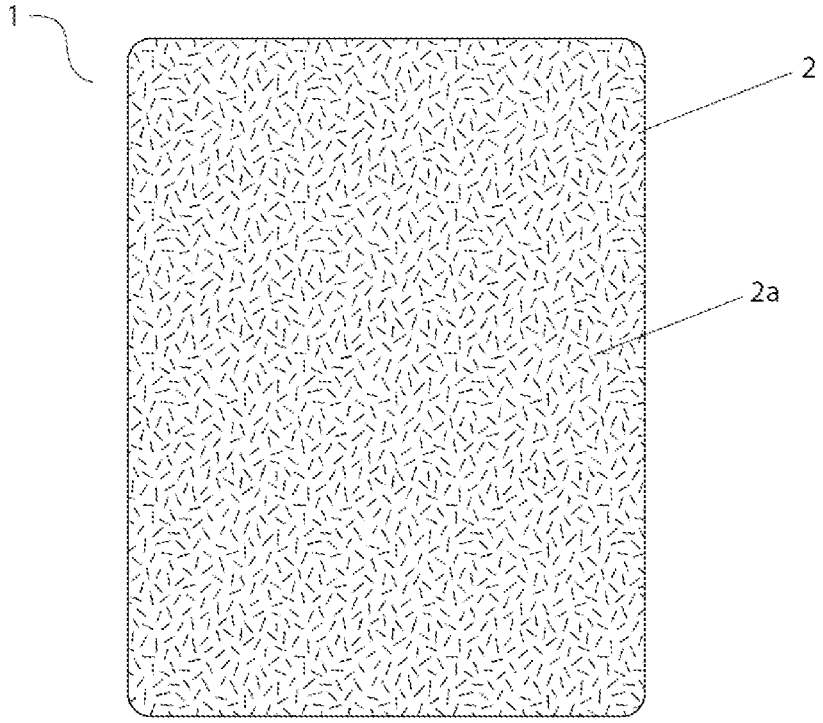
FIG. 2. Back view of a mounting panel, according to the present invention.
Figure 4:
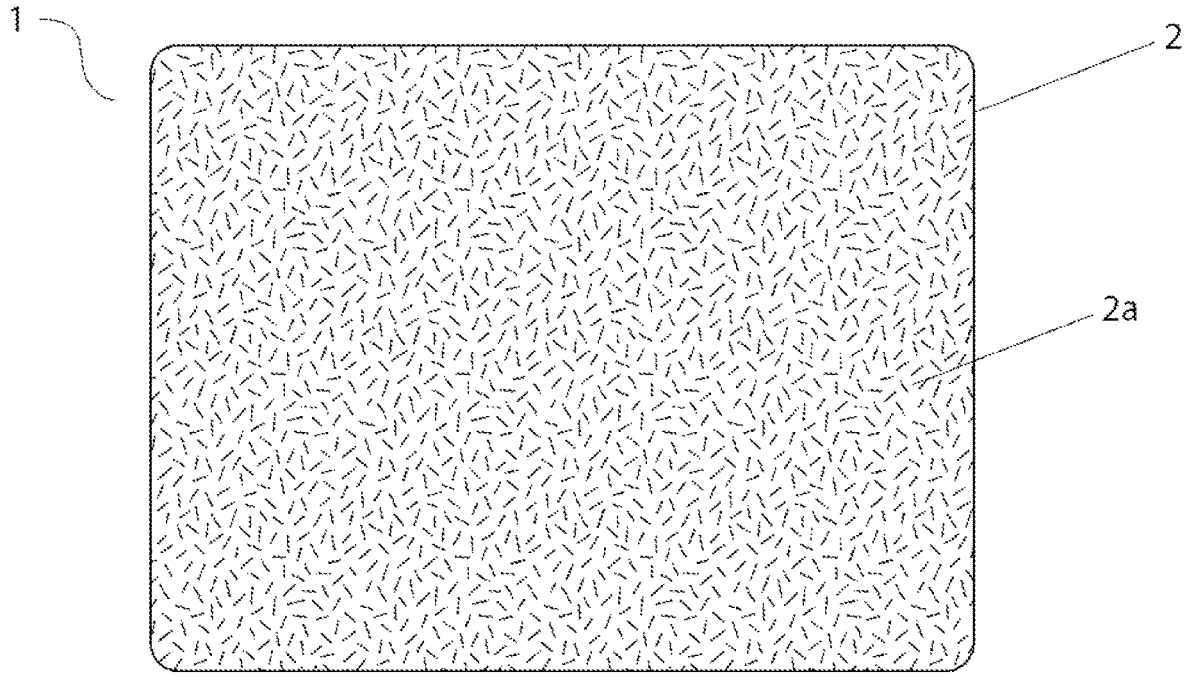
FIG. 4. Back facing view of a mounting panel, according to the present invention.
Figure 7:
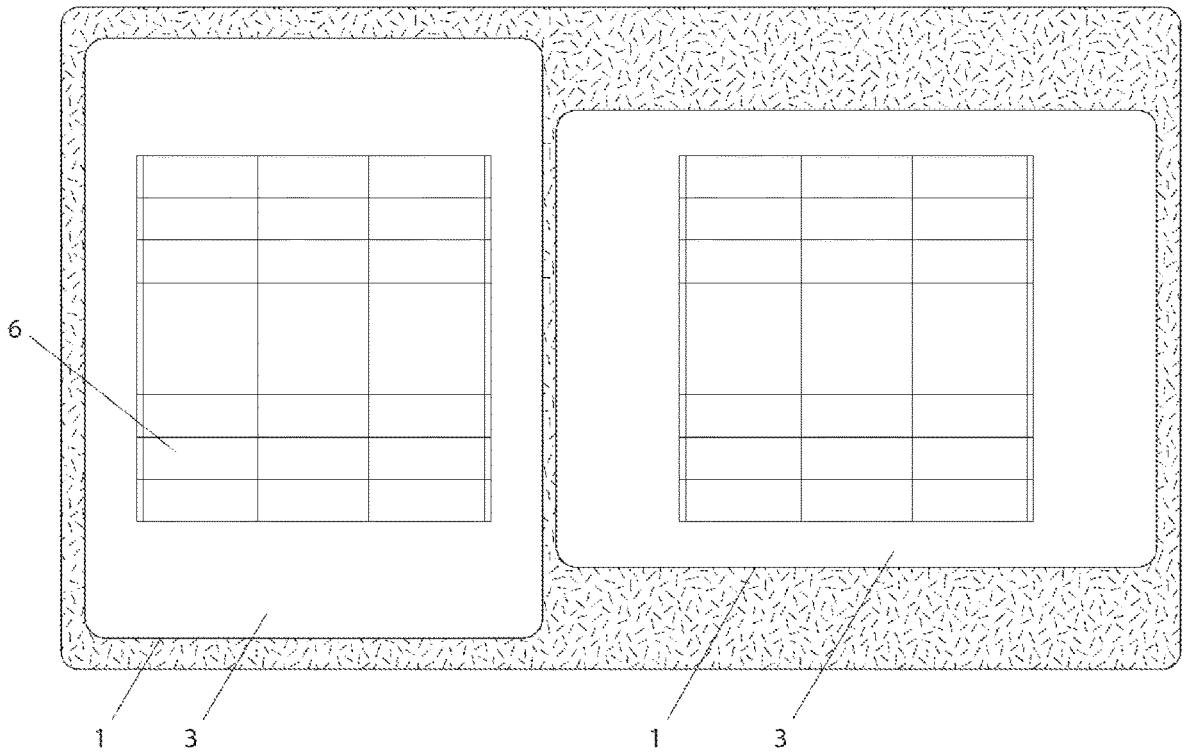
FIG. 7. Front view of a mounting panel(s) attached to an interior of a container according to the present invention.
Figure 8:
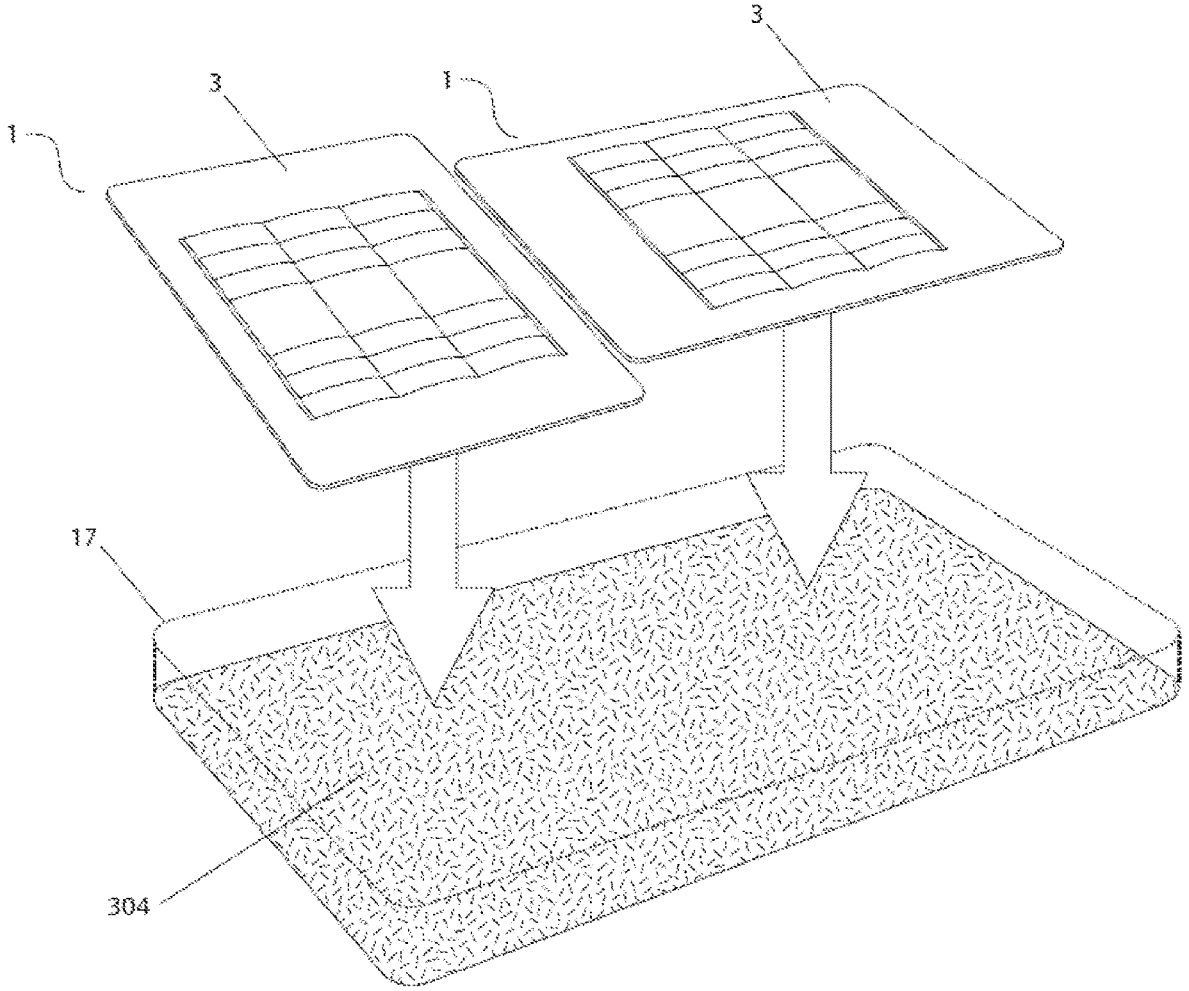
FIG. 8. Schematic illustration of placing mounting panels to an interior surface of a container according to the present invention.
Figure 9:
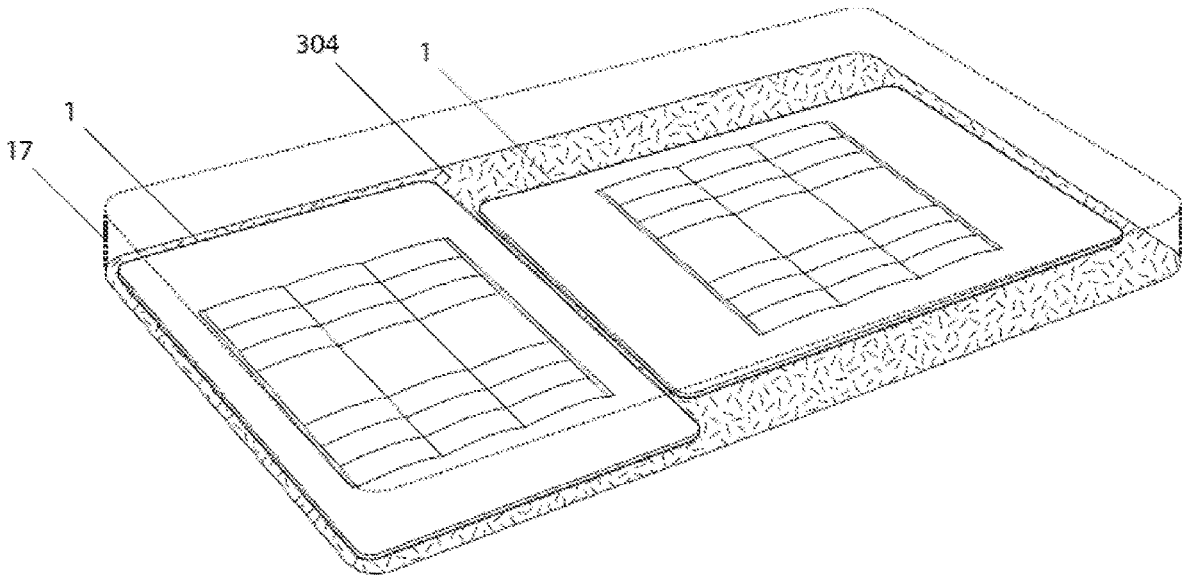
FIG. 9. Perspective view showing mounting panels attached to an interior surface of a container according to the present invention.

The back side 2 of mounting panel 1 is configured to or includes a mounting surface to engage with a corresponding mounting surface, such as to an interior surface 304 of a container 17, 170. Preferably, as shown in FIGS. 2 and 4, the back side 2 is covered with hook or loop fastener material 2*a*, such as VELCRO™, or at least partially covered with hook or loop fastener material, for anchoring or releasable attachment to corresponding loop or hook fastener material on the interior surface 304 of a container 17, as shown in FIGS. 7-9. FIG. 8 illustrates the accommodation of the mounting panels 1 to an interior surface 304 of a container 17, such as a backpack.

Figure 3:
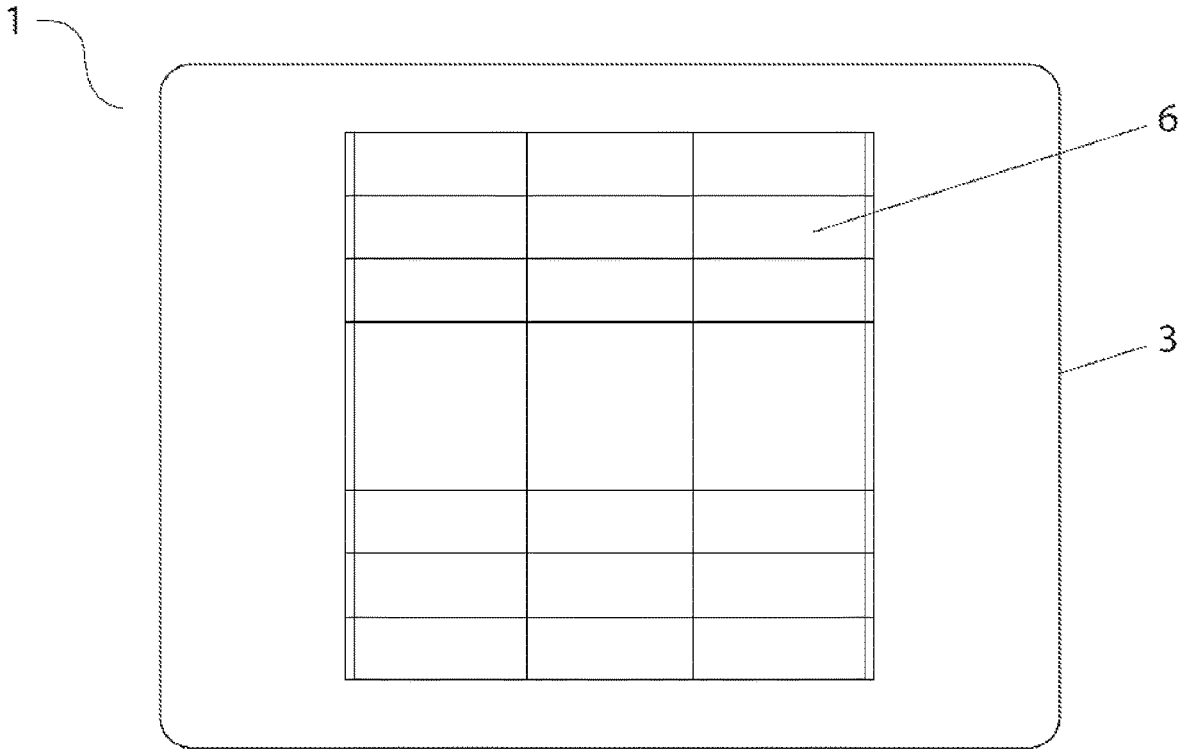
FIG. 3. Front facing view of a mounting panel, according to the present invention.

FIGS. 1 and 2 illustrate a mounting panel 1 having a rectangular shape while FIGS. 3 and 4 illustrate a mounting panel 1 having a square shape. Other possible shapes include circular, triangular, pentagonal, hexagonal and so forth.

Figure 12B:
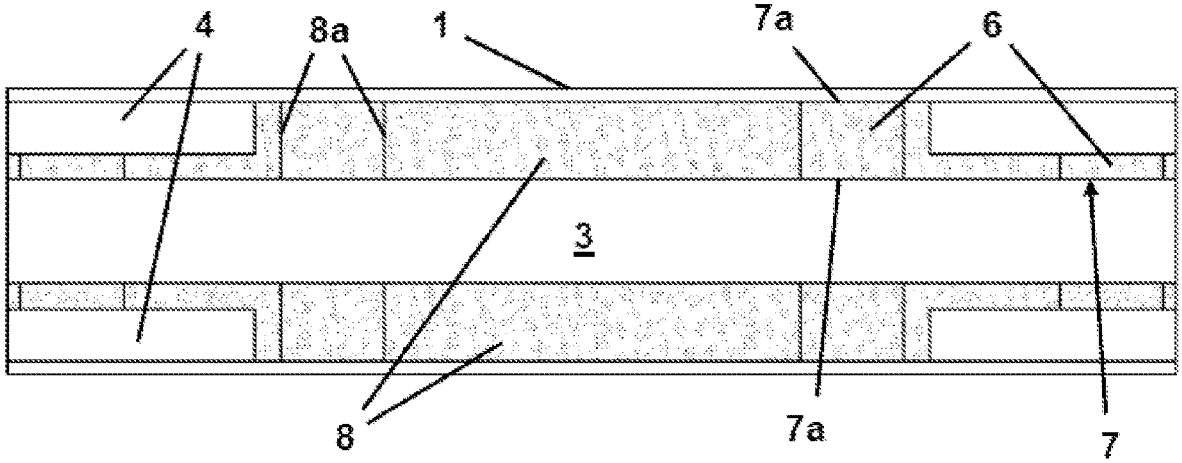
FIG. 12B is a front view of the mounting panel.
Figure 14:
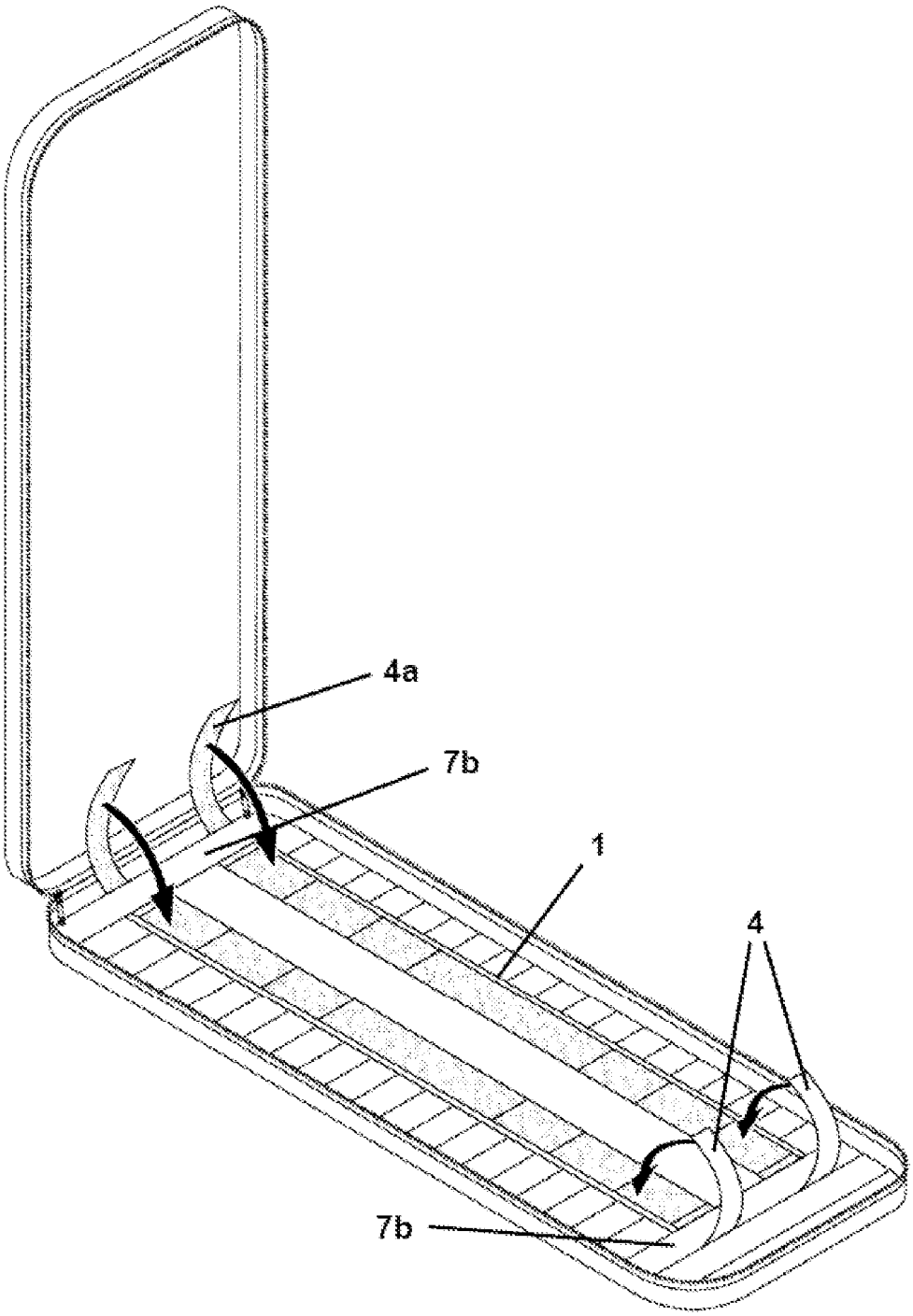
FIG. 14 is a perspective view of the embodiment of the mounting panel shown in FIG. 13, engaged with the mounting surface.
Figure 15:
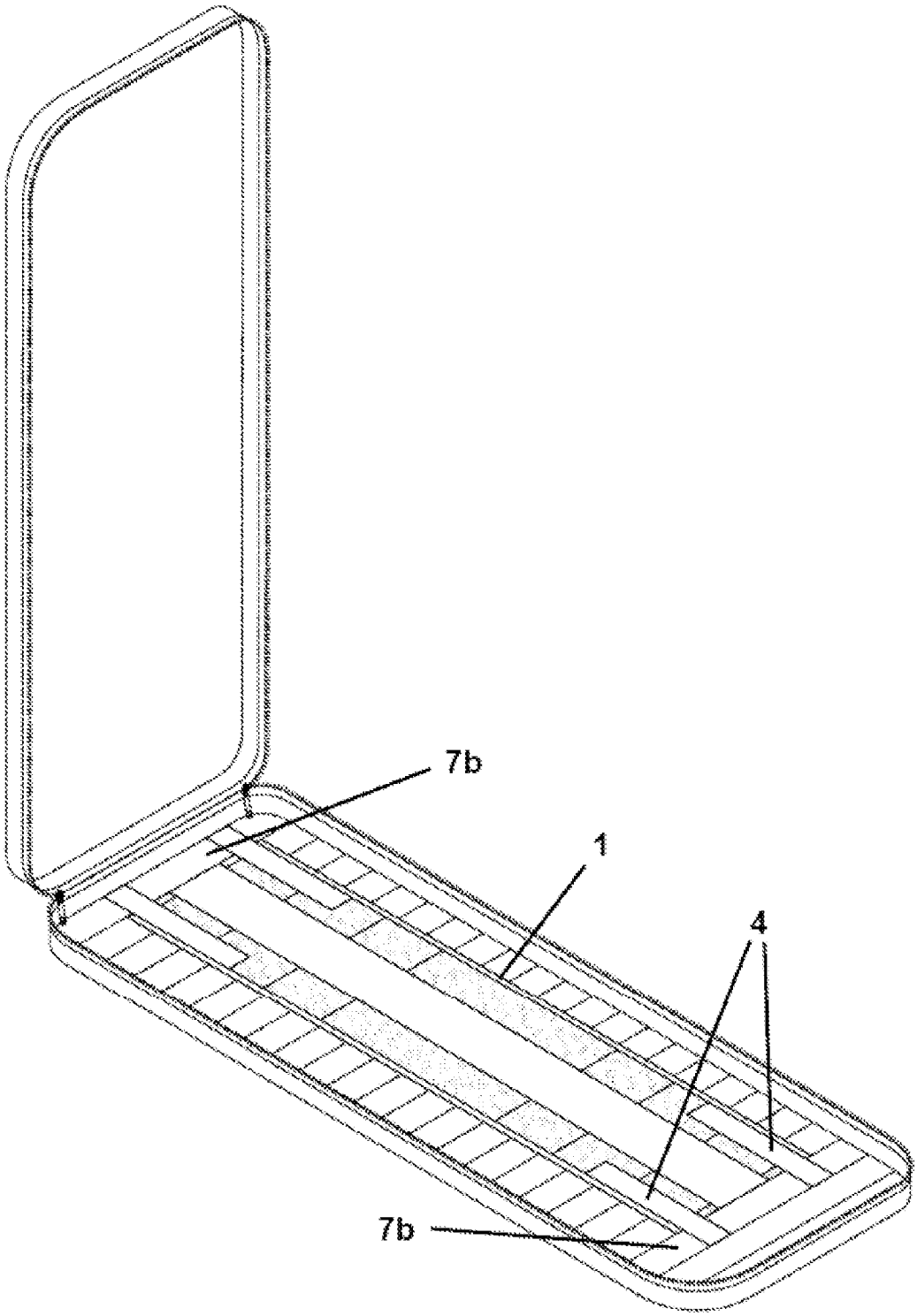
FIG. 15 is a perspective view of the embodiment of the mounting panel shown in FIG. 15, engaged with the mounting surface.
Figure 16A:
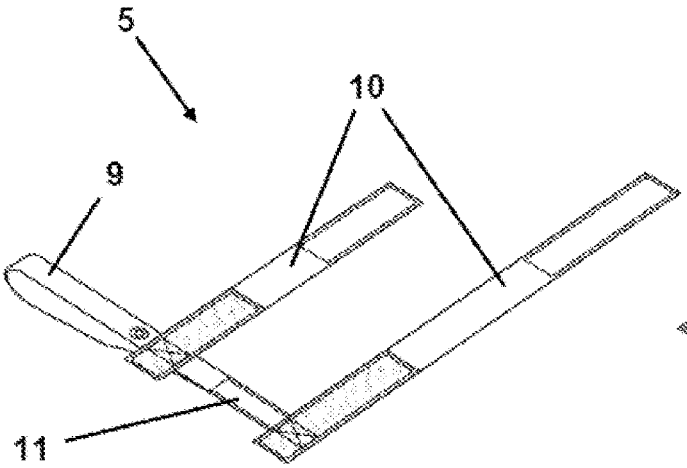
FIG. 16A is a bottom perspective view of one embodiment of the quick-release strap, according to the present invention.
Figure 16B:
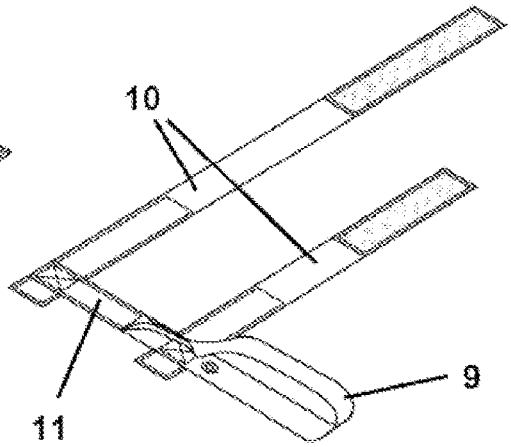
FIG. 16B is a top perspective view of the embodiment of the quick-release strap shown in FIG. 16A.
Figure 16C:
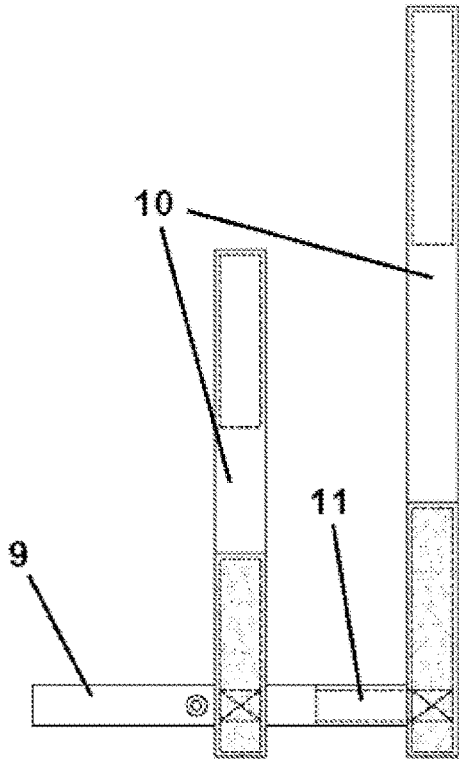
FIG. 16C is a bottom view of the embodiment of the quick-release strap shown in FIG. 16A.
Figure 16D:
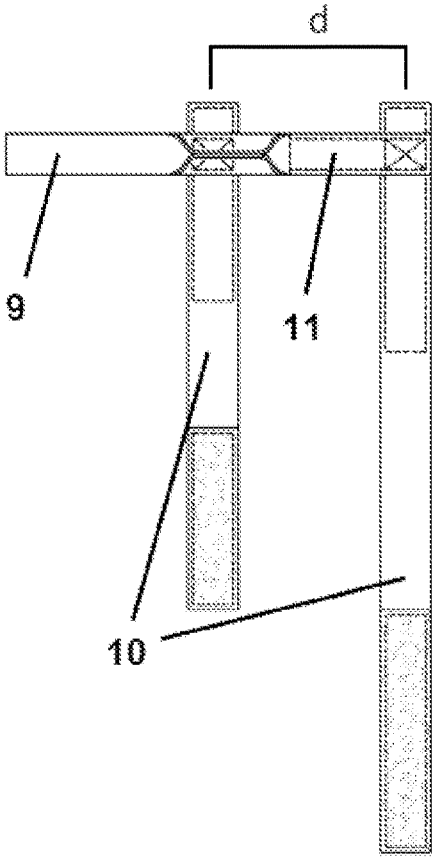
FIG. 16D is a top view of the embodiment of the quick-release strap shown in FIG. 16A.
Figure 17A:
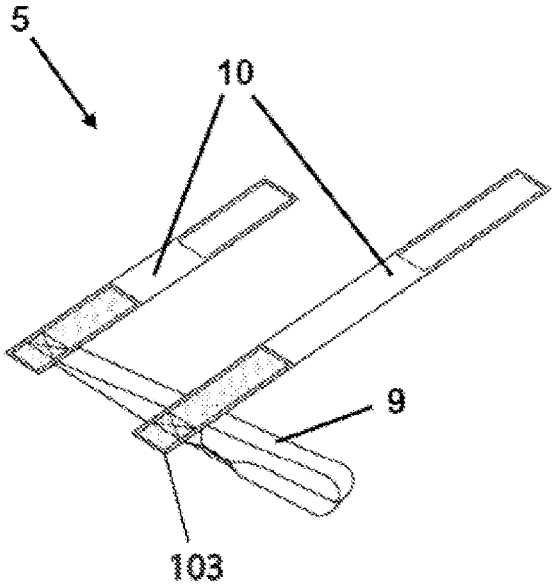
FIG. 17A is a bottom perspective view of another embodiment of the quick-release strap.
Figure 17C:
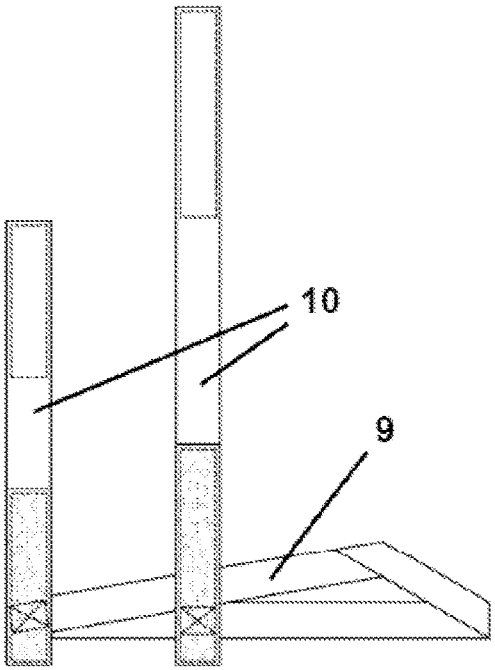
FIG. 17C is a bottom view of the embodiment of the quick-release strap shown in FIG. 17A.
Figure 17B:
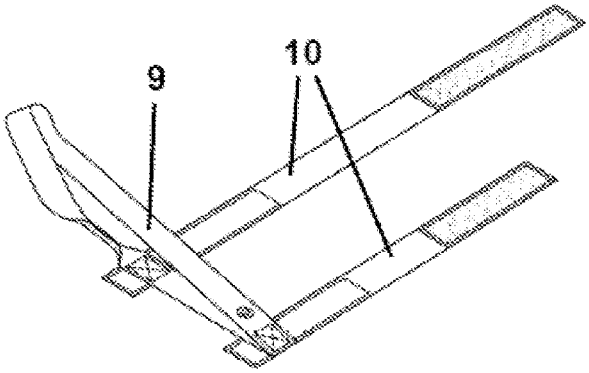
FIG. 17B is a top perspective view of the embodiment of the quick-release strap shown in FIG. 17A.
Figure 17D:
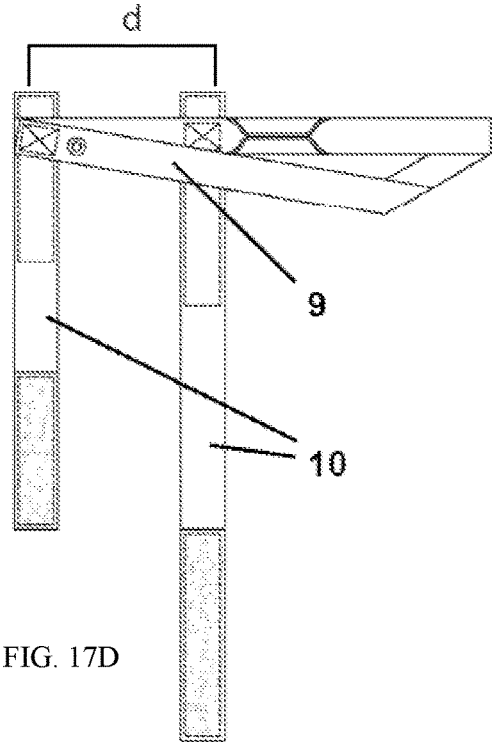
FIG. 17D is a top view of the embodiment of the quick-release strap shown in FIG. 17A.
Figure 18A:
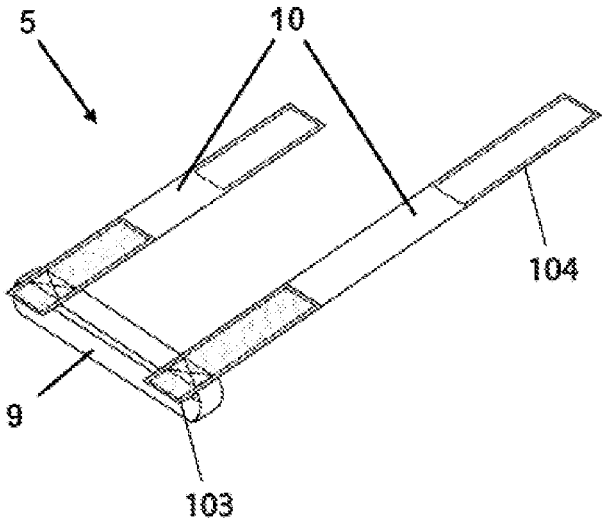
FIG. 18A is a bottom perspective view of yet another embodiment of the quick-release strap.
Figure 18C:
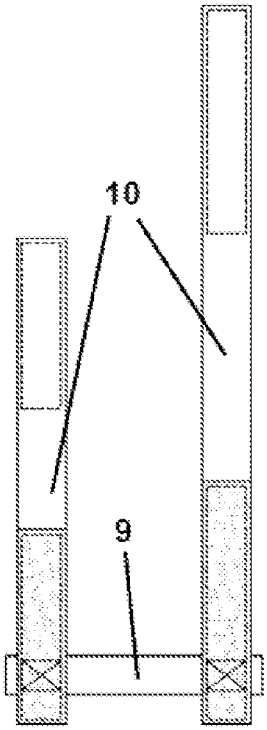
FIG. 18C is a bottom view of the embodiment of the quick-release strap shown in FIG. 18A.
Figure 18B:
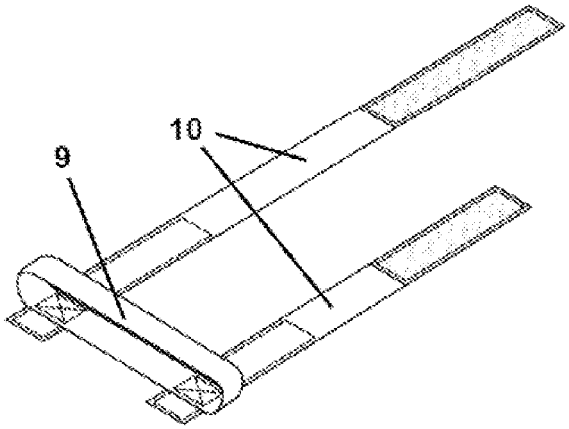
FIG. 18B is a top perspective view of the embodiment of the quick-release strap shown in FIG. 18A.
Figure 18D:
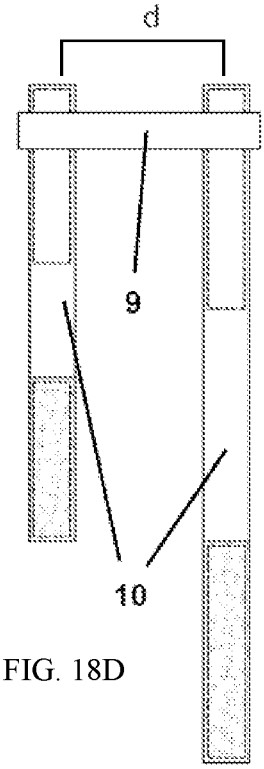
FIG. 18D is a top view of the embodiment of the quick-release strap shown in FIG. 18A.

In addition, or in place of the hook or loop fastener material 2*a*, the back side 2 may be provided with other attachment or securement means for engaging with the mounting surface. As shown in FIGS. 12B, 13-15, the mounting panel 1 may be provided with tabs 4 extending from one or both ends of the mounting panel 1. As shown in FIG. 14, one side of the tabs 4 is provided with hook or loop fastener material 4*a*. The tabs 4 may be fed through loops or channels 7*b* on the mounting surface. The hook or loop fastener material 4*a* may then be secured to, respectively, loop or hook fastener material on the back side 2 or front side 3 of the mounting panel 1, thereby securing the mounting panel 1 to the mounting surface. Preferably, the hook or loop fastener material 4*a* is attached to, respectively, loop or hook fastener material 8*b*, as shown in FIGS. 12A and 12B. As another means of engagement, the back side 2 may have strips of webbing attached thereto, forming a PALS grid, for engagement with a complementary PALS grid on the mounting surface. Preferably, where the mounting panel 1 is secured to the mounting surface by way of a PALS grid, two pairs of straps (not shown) are provided on the back side 2 of the mounting panel 1 for weaving between the complementary PALS grids to thereby secure the mounting panel 1 to the mounting surface.

Other known methods of anchoring or releasably attaching a sheet-like structure to the mounting surface of a container may be used. Preferably, the mounting panel 1 is releasably attached to the mounting surface of the container, however, the mounting panel 1 may be permanently attached to the mounting surface of the interior of the bag. Alternatively, the mounting panel 1 may be formed integrally with the mounting surface of the interior of the bag.

With reference to FIGS. 1-11 the front side 3 of mounting panel 1 is configured to engage with a quick-release strap 5 to thereby secure a firearm 362 against the mounting panel 1 on the mounting surface of a container or bag. The front side 3 is provided one or more panel loops 6 extending therefrom. Each panel loop 6 forms an open channel 7 between the panel loop 6 and the front surface 3 of mounting panel 1, which is open at both ends 7*a*.

Figure 5:
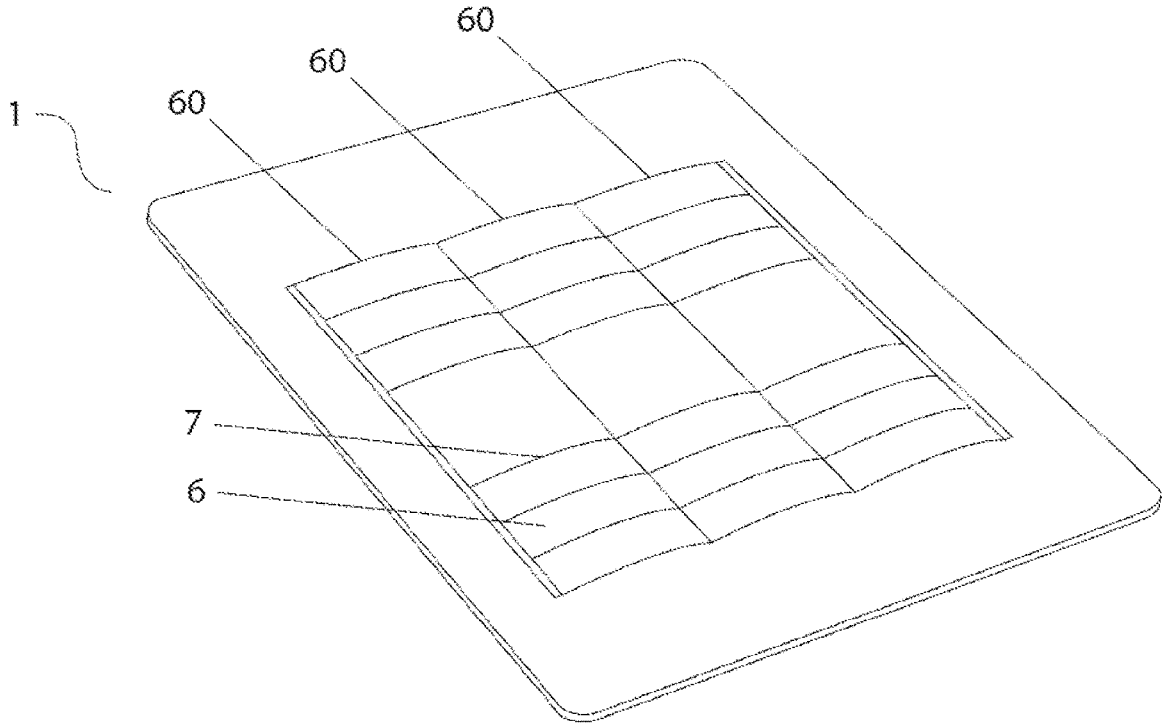
FIG. 5. Front perspective view of a mounting panel, according to the present invention.
Figure 6:
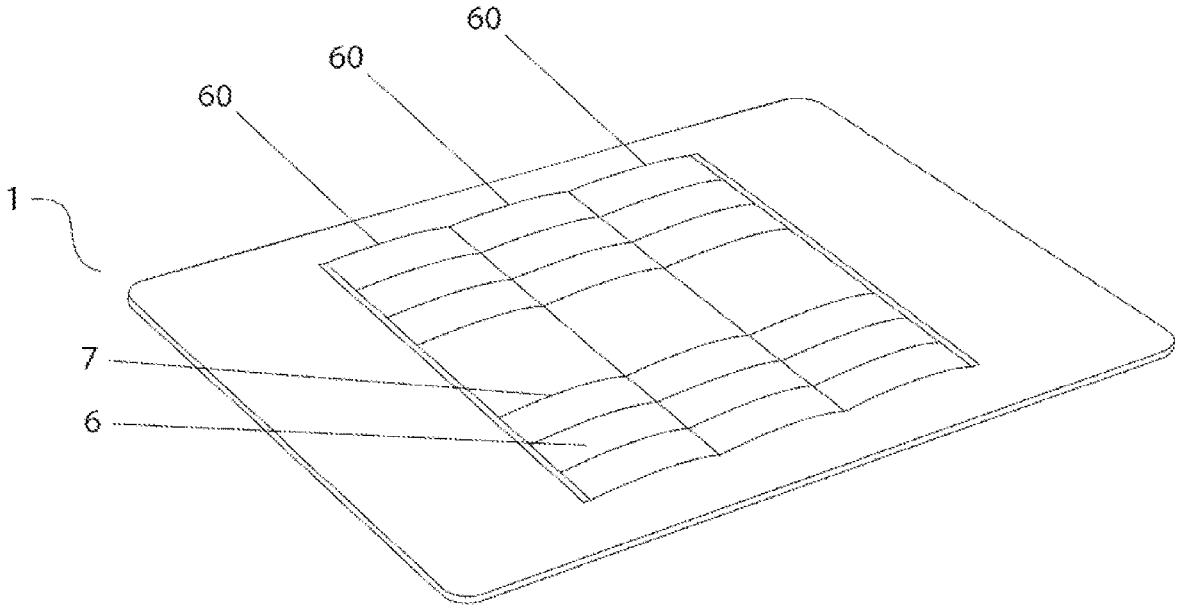
FIG. 6. Front facing isometric view of a mounting panel, according to the present invention.

As shown in FIGS. 5 and 6, the loops 6 can be arranged in columns 60 of loops 6. The mounting panel 1 may include 1 or more columns 60 of one or more loops 6. An arrangement having a plurality of columns 60 having a plurality of loops 6 each, is advantageous for accommodating firearms, such as rifles, of different sizes and designs.

As shown in FIGS. 12A and 12B, in another embodiment, two or more strips of webbing 8 are attached at a plurality of locations 8*a* along the front side 3. A single strip of webbing 8 may be used instead of two or more. The panel loops 6 are thereby defined between the points of attachment of the strips of webbing 8, at locations 8*a*. The strips of webbing 8 may extend along the full length of the mounting panel 1, as shown in FIGS. 12A and 12B, or in some applications may be less than the full length of the mounting panel 1. For example, the strips of webbing 8 may extend from one end of the mounting panel 1 to about the midpoint of the mounting panel 1. Alternatively, the panel loops 6 may be formed from separate strips of webbing, which may be aligned or offset, angled, or otherwise variously arranged with respect to one another, to suit the configuration of the equipment to be secured to the mounting panel 1.

Quick Release Strap

As shown in FIGS. 16A-D, 17A-D, 18A-D, the quick-release strap 5 includes a grip portion 9 and two strap portions 10. Preferably, the grip portion 9 and strap portions 10 are made of durable nylon material, such as CORDURA™ fabric, but other durable materials may also be used. The grip portion 9 has a loop, or handle, or other suitable structure to allow a person to grip and pull the quick-release strap 5. In the figures one of the straps 10 is shown as being longer than the other, however, the two straps may be of equal length.

Figure 10:
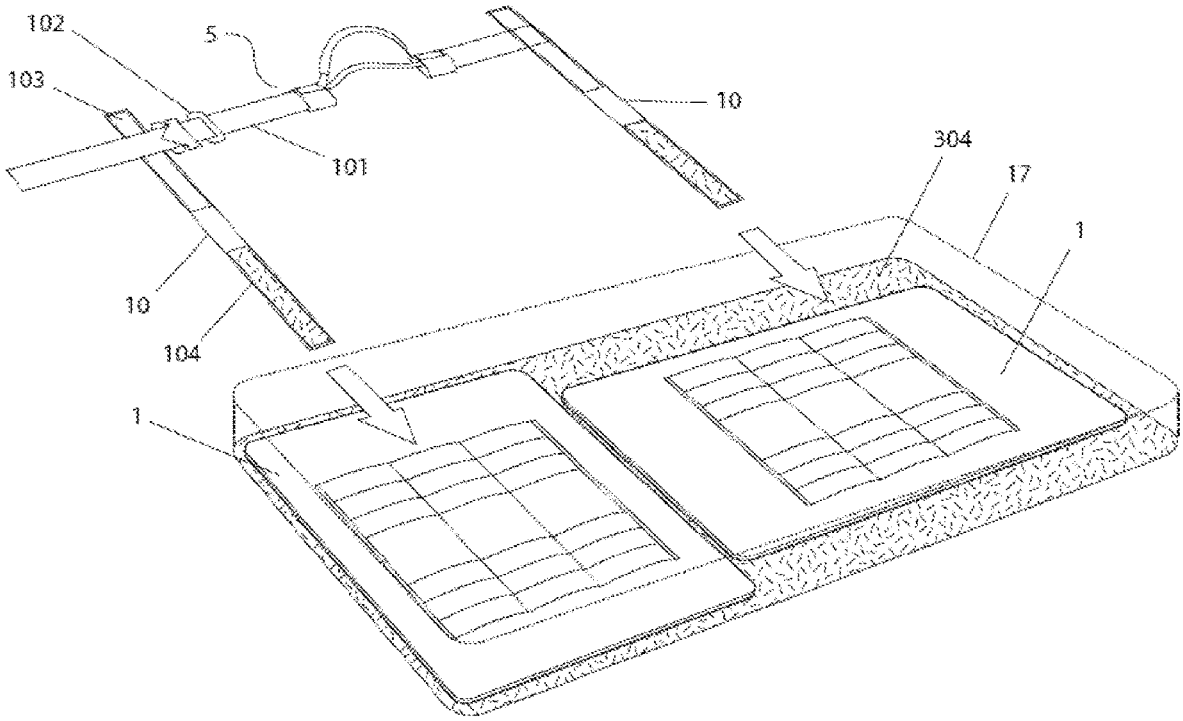
FIG. 10. Schematic illustration showing quick release strap being coupled to the mounting panels according to the present invention.

In one embodiment, shown in FIG. 10, the quick release strap also includes a link strap 101. As shown in FIG. 10, the grip portion 9 may be releasably coupled to a link strap 101 having adjustable means 102 such as a tri-glide buckle which allows manipulation of the length of the link strap 101. In this embodiment, the length of the link strap 101 can be manipulated to adjust the distance between the two strap portions 10 so that strap portions 10 are permitted to pass through channels 7 of choice. The choice of the distance between the strap portions 10 may depend, among other things, on the size of the firearm being carried. In this embodiment, each strap portion 10 may include a first end 103 attached or coupled to the link strap 101, and an opposite free second end 104.

In another embodiment, as shown in FIGS. 17A-D and 18A-D, each strap portion 10 may include a first end 103 attached or coupled to the grip portion, and an opposite free end 104. End 103 may be attached directly to the grip portion 9. In another embodiment, one or both straps 10 may be attached to an intermediate portion 11, between the strap portions 10 and the grip portion 9, as shown in FIGS. 16A-D. The quick-release strap 5 may be configured for left-handed use, as shown in FIGS. 16A-D, right-handed use, as shown in FIGS. 17A-D, or either right or left-handed use, as shown in FIGS. 18A-D and 10. The strap portions 10 can be spaced apart from one another by the same distance d as the panel loops 6 and have a width less than the width of the channels 7.

Figure 21:
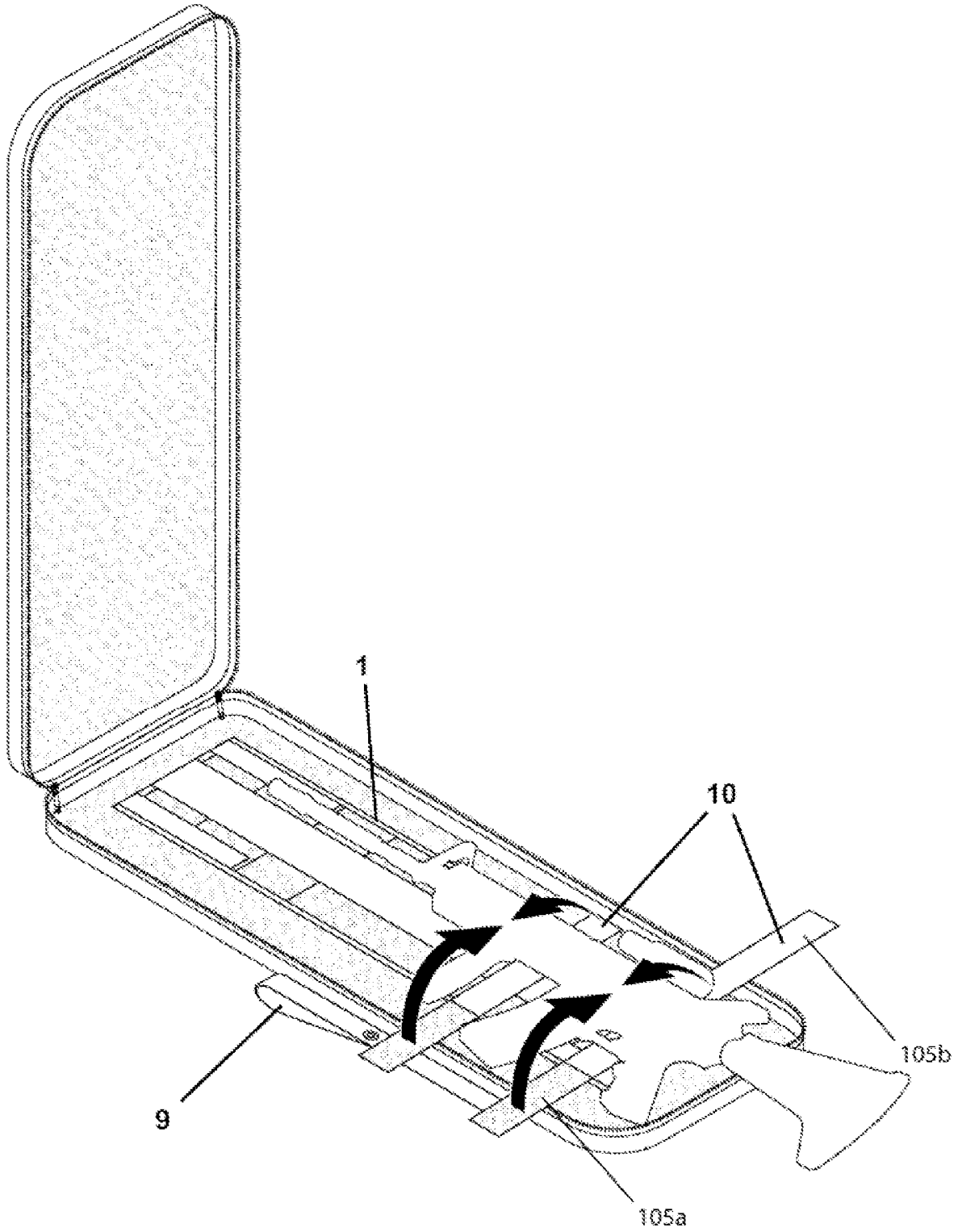
FIG. 21 is a perspective view of the quick-release mounting system, showing the opposing ends of the strap portions being releasably attached about the securement points on the rifle.
Figure 22:
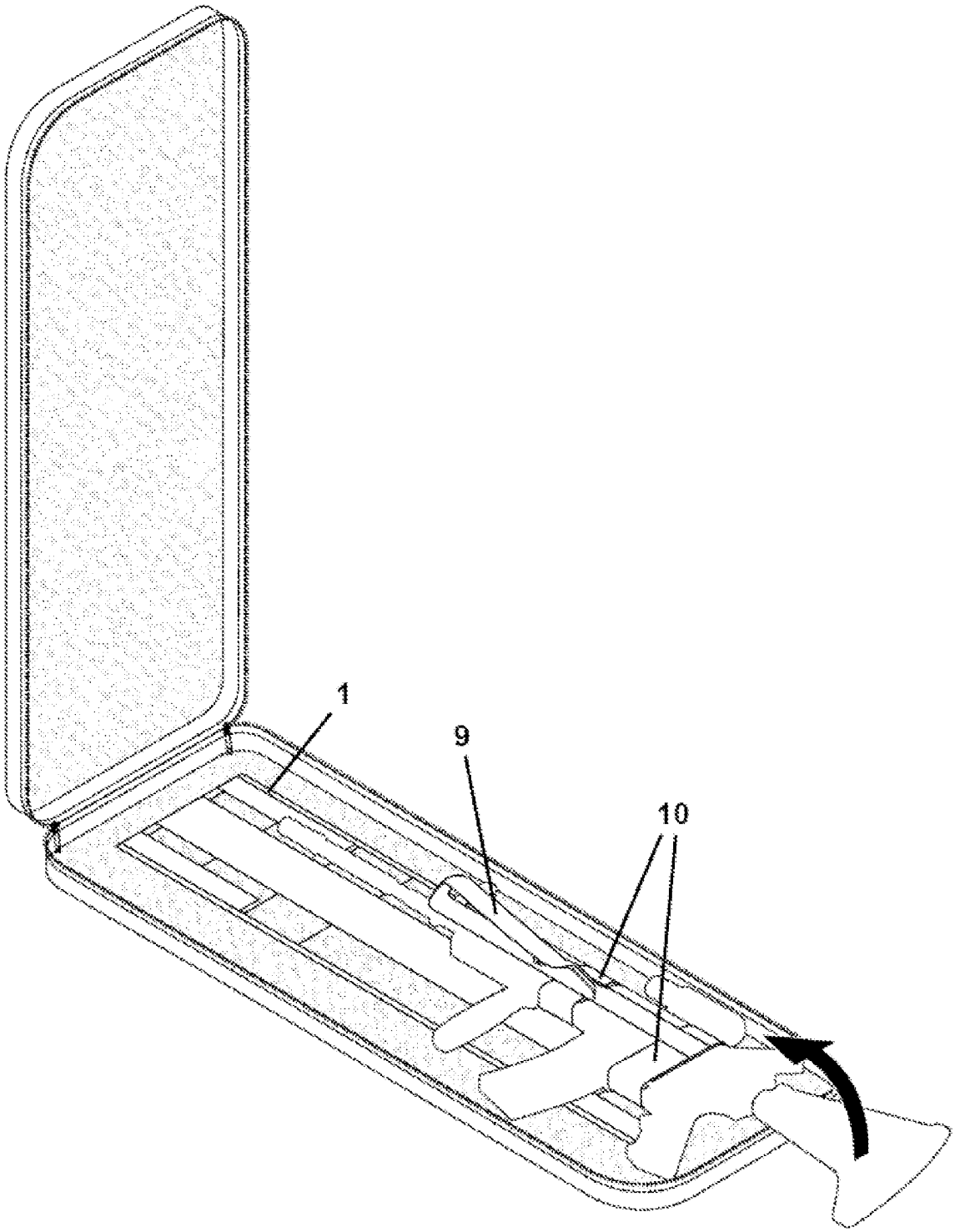
FIG. 22 is a perspective view of the quick-release mounting system, showing the stock of the rifle being folded down.
Figure 23:
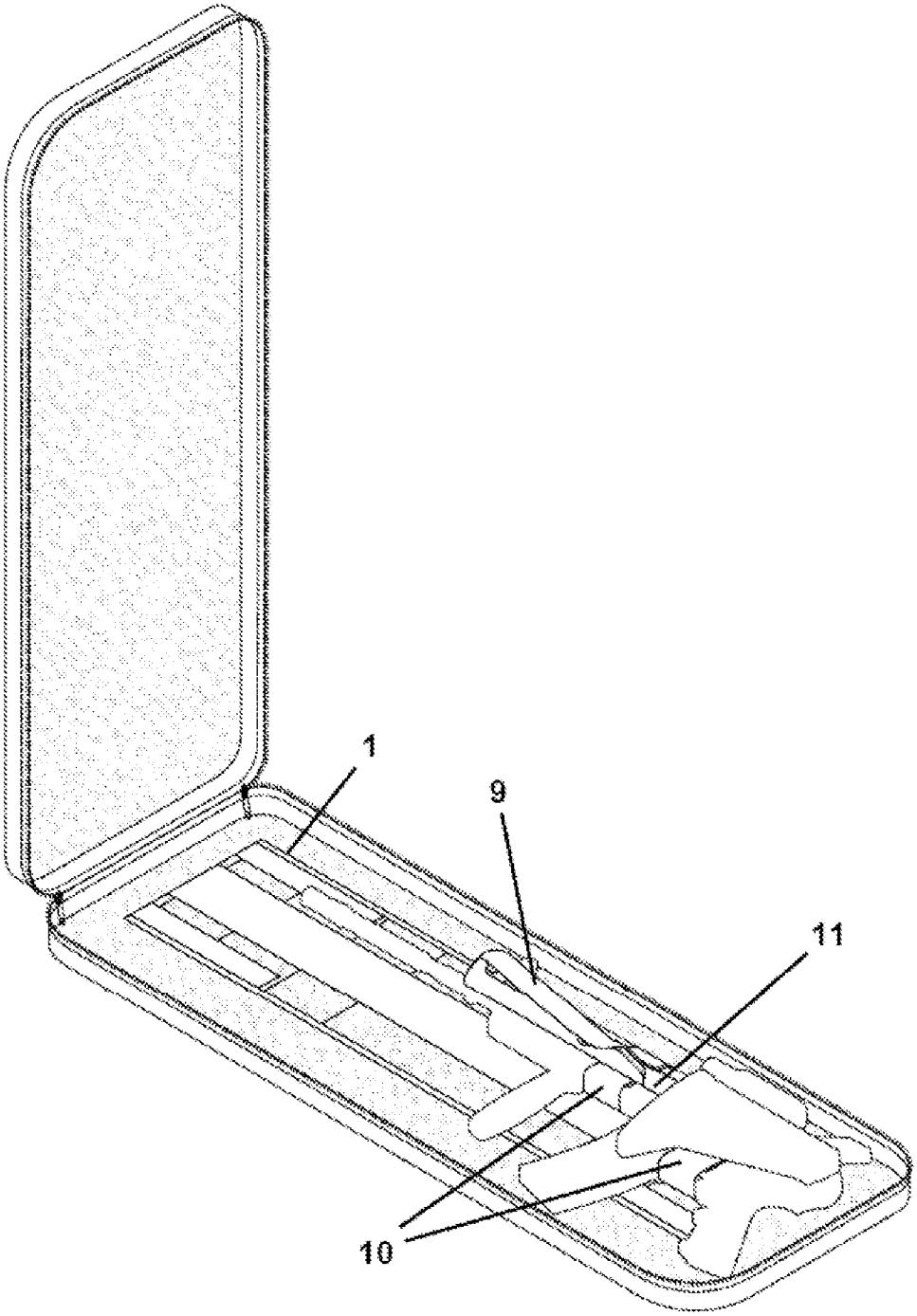
FIG. 23 is a perspective view of the quick-release mounting system, showing a rifle releasably secured to a mounting surface by way of the quick-release strap shown in FIGS. 16A-D.
Figure 24:
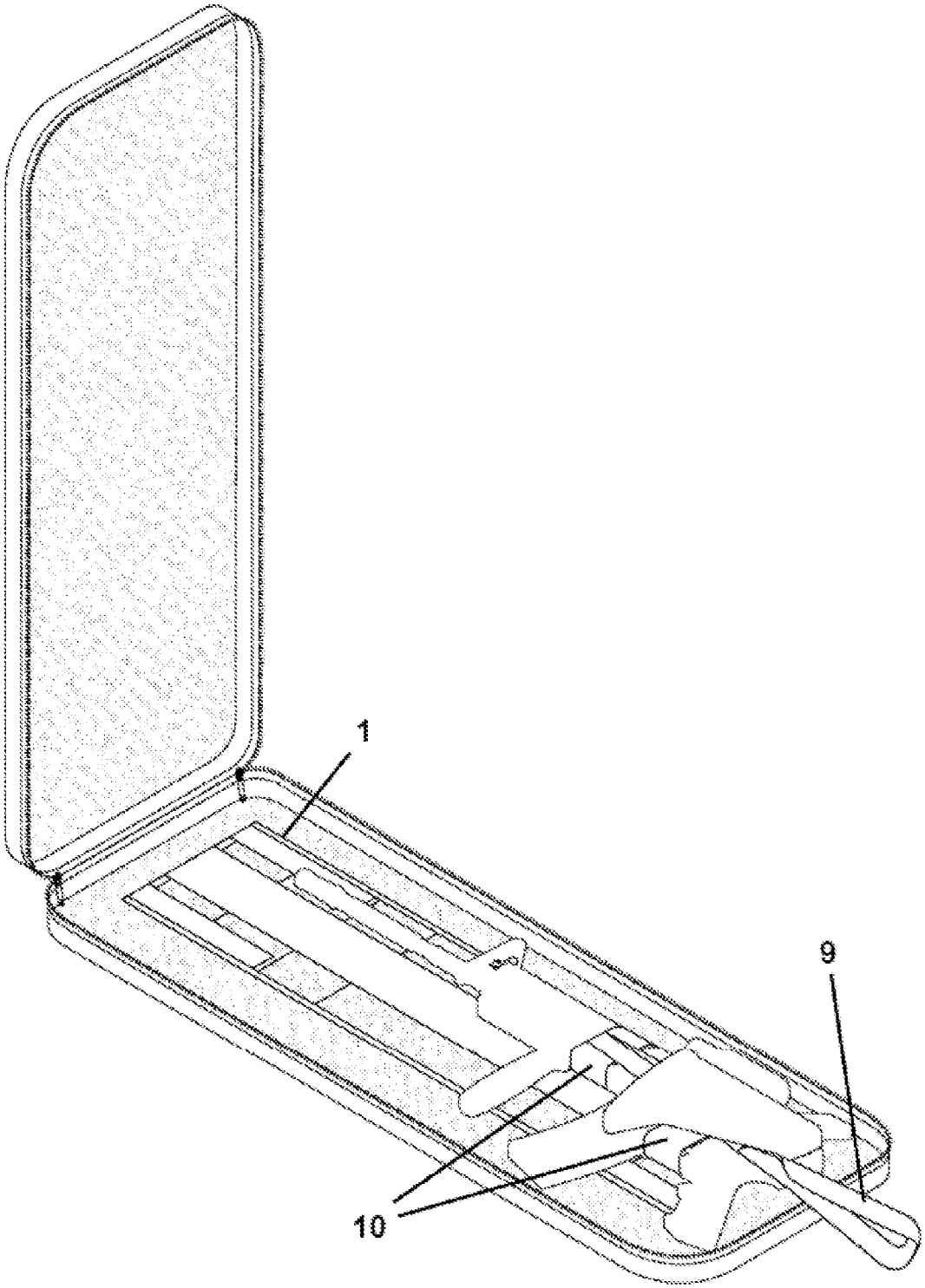
FIG. 24 is a perspective view of the quick-release mounting system, showing a rifle releasably secured to a mounting surface by way of the quick-release strap shown in FIGS. 17A-D.
Figure 25:
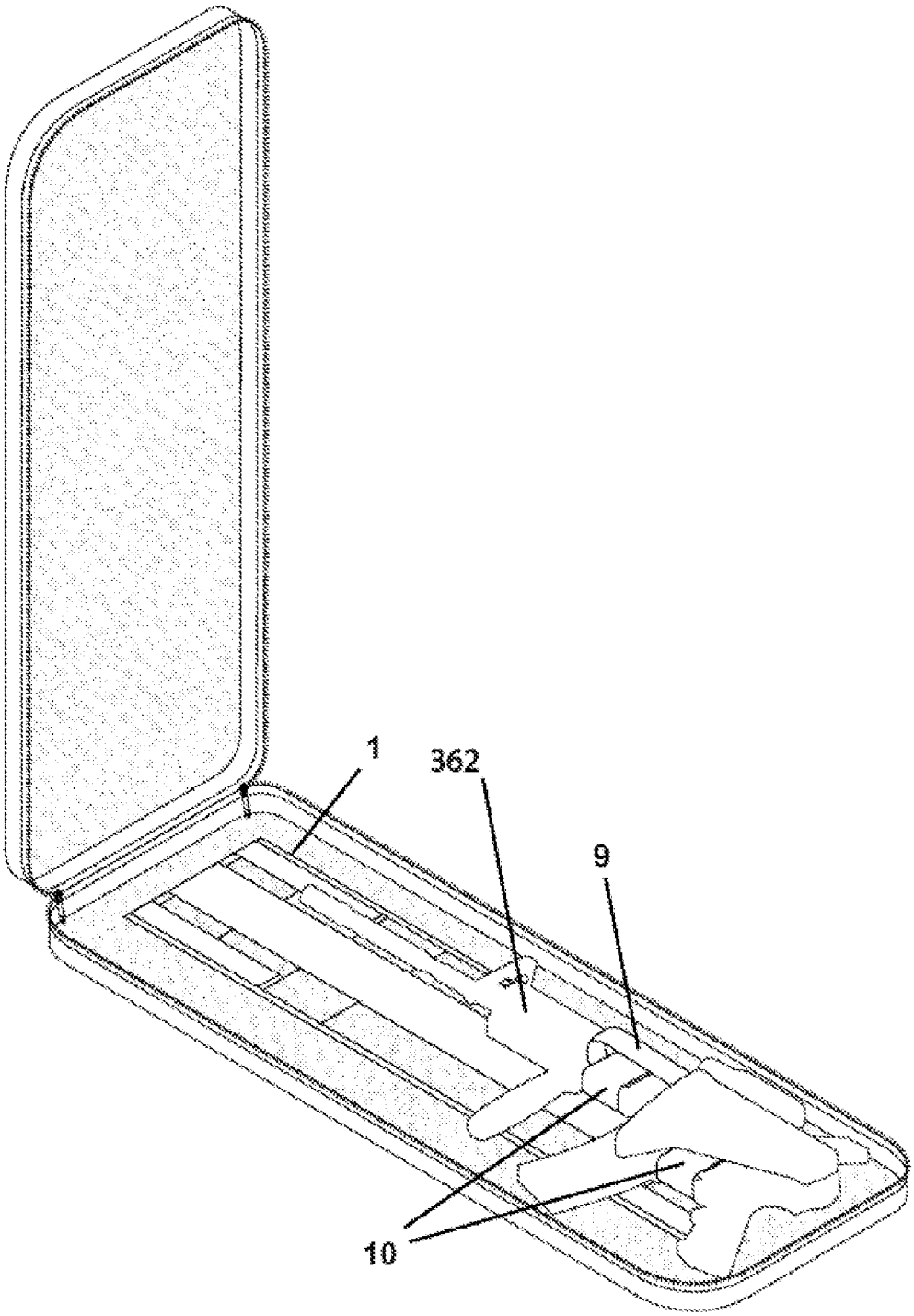
FIG. 25 is a perspective view of the quick-release mounting system, showing a rifle releasably secured to a mounting surface by way of the quick-release strap shown in FIGS. 18A-D.

Each free end 104 of the strap portions 10 is configured to releasably attach to the opposing end 103 of the strap portion 10 to thereby form a strap loop, as shown in FIG. 21 by the curved arrows. Preferably, one end of each of the strap portions 10 is provided with hook or loop fastener material 105*a* and the other end is provided with corresponding loop or hook fastener material 105*b*. Alternatively, other quick release attachments may be used to releasably attach the opposing ends of the strap portions 10, such as quick release buckles. The length of the strap portions 10 may be sized to accommodate various attachments on the rifle, such as a scope.

Quick Release (QR) Bag

As describe above, a quick-release strap 5 is anchored or releasably attached to a mounting panel 1 and serves to releasably secure a firearm, such as a rifle, to the mounting panel 1. In turn, the mounting panel 1 is anchored or releasably attached to a mounting surface, such as the interior of a container. In this way, a properly secured rifle is carried in the container by a person who can quickly and easily access the rifle by grasping and pulling the quick-release strap 5 to thereby release the rifle from its securement on the mounting panel 1 and container.

In another embodiment, the present invention relates to a quick-release (QR) bag that further facilitates the quick release of the firearm from the bag. Different embodiments of a QR bag 170, which could be a hand-held or shoulder bag according to this embodiment, are shown in FIGS. 26-34.

Figure 26:
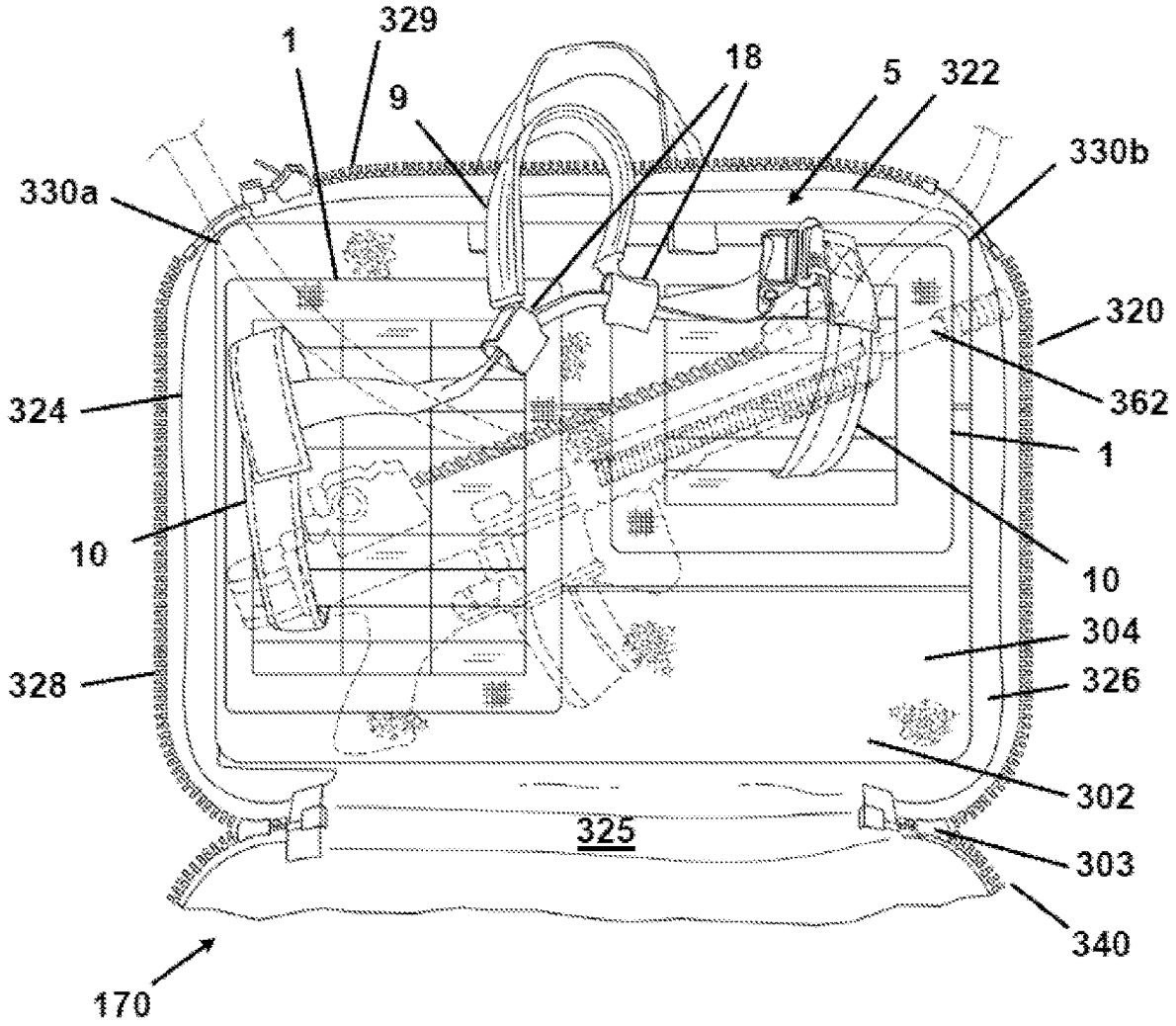
FIG. 26 is a front view of another embodiment of the quick-release mounting system, with the front open to show a rifle mounted in a shoulder bag.
Figure 27:
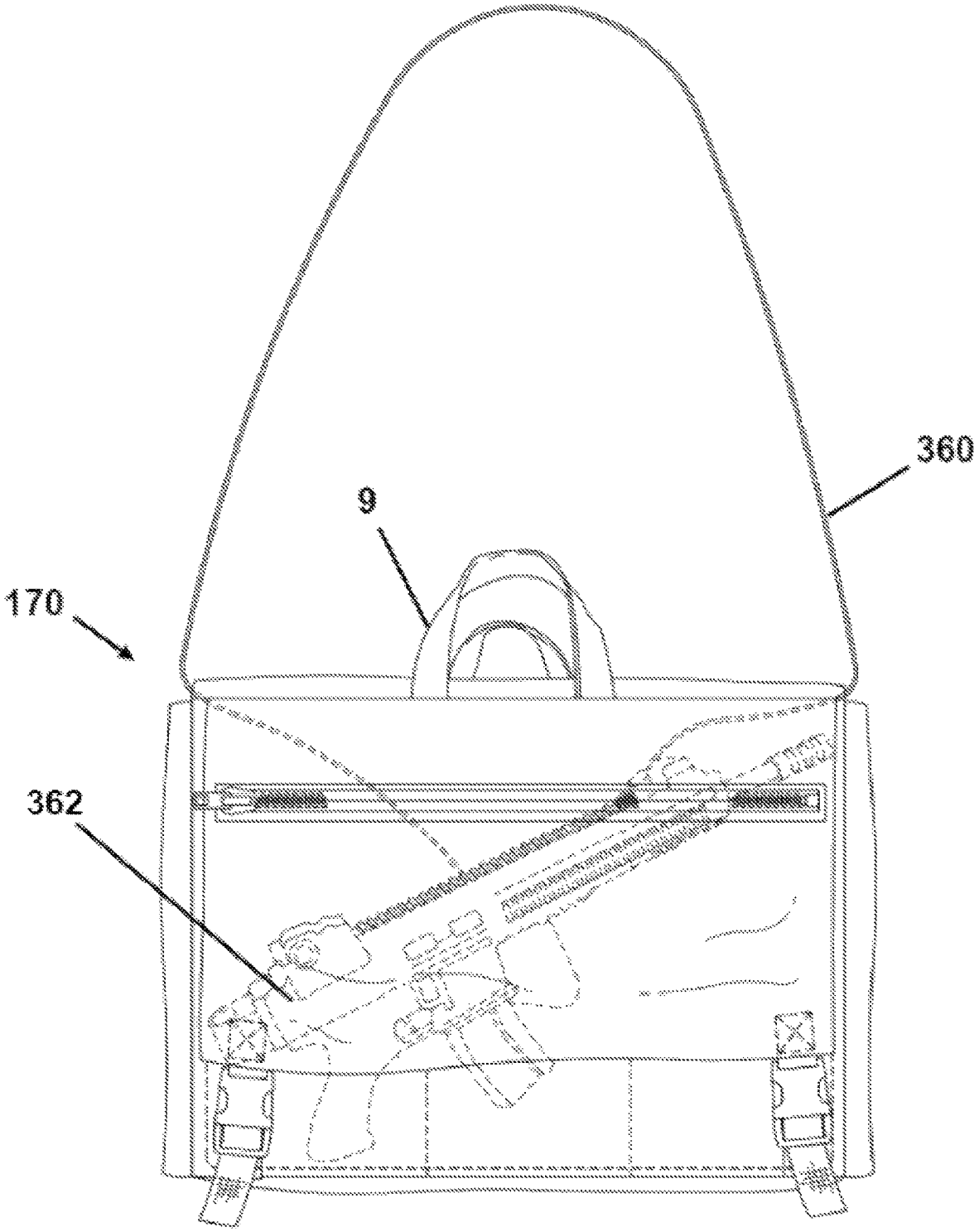
FIG. 27 is another front view of the shoulder bag of FIG. 26, showing a rifle releasably secured therein.
Figure 28:
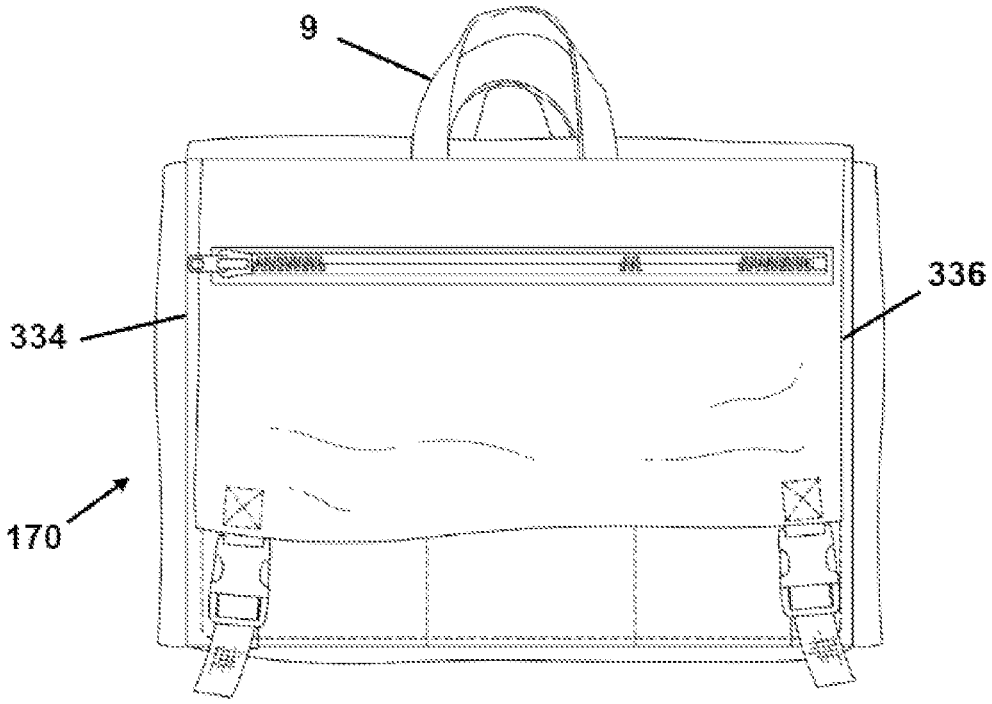
FIG. 28 is a front view of the shoulder bag of FIG. 26.
Figure 29:
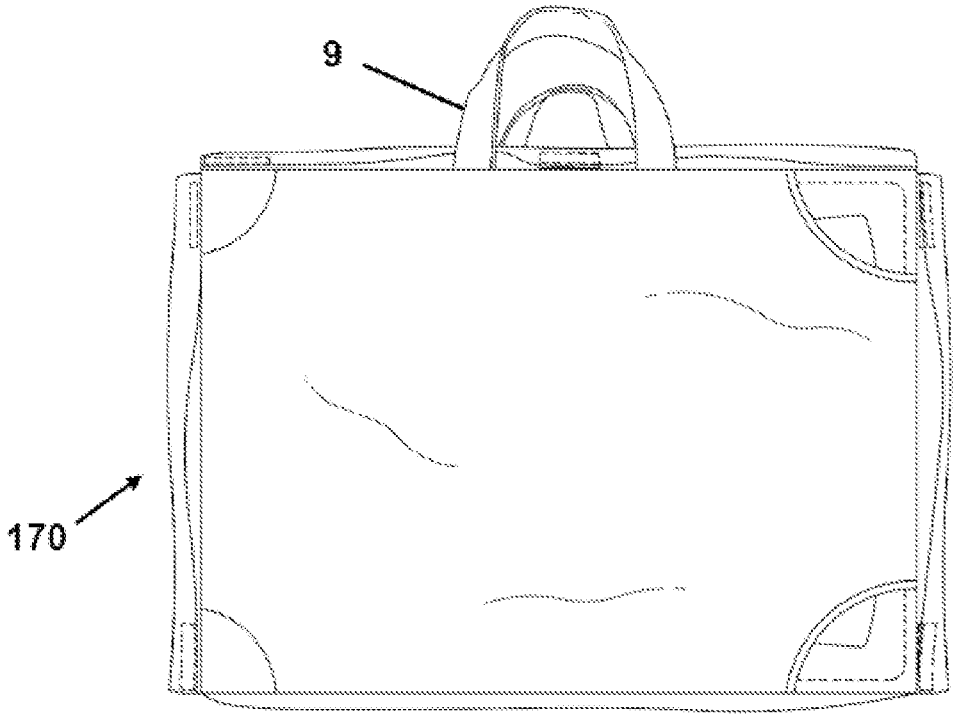
FIG. 29 is a rear view of the shoulder bag of FIG. 26.
Figure 30:
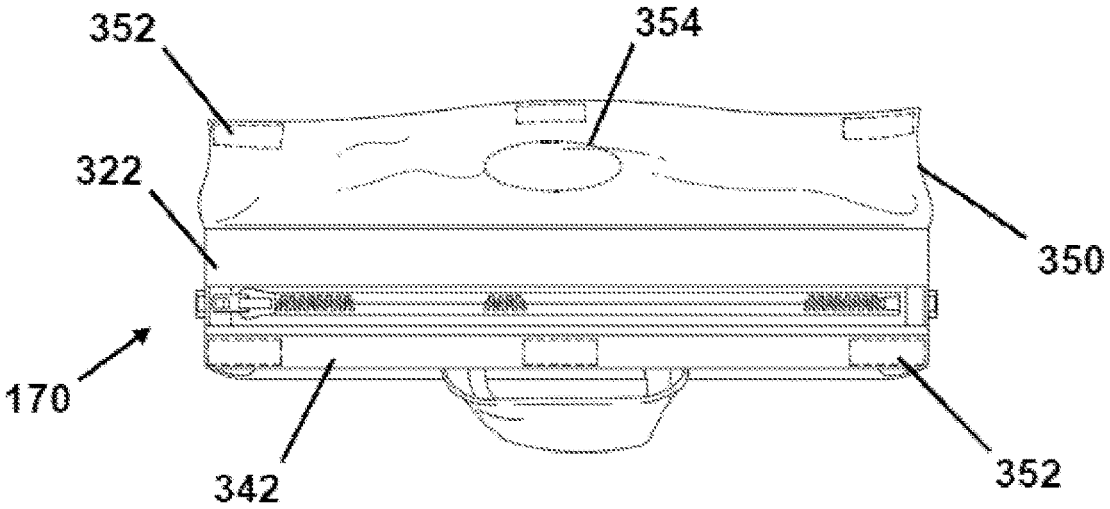
FIG. 30 is a top view of the shoulder bag of FIG. 26, showing an expandable rear section.
Figure 31:
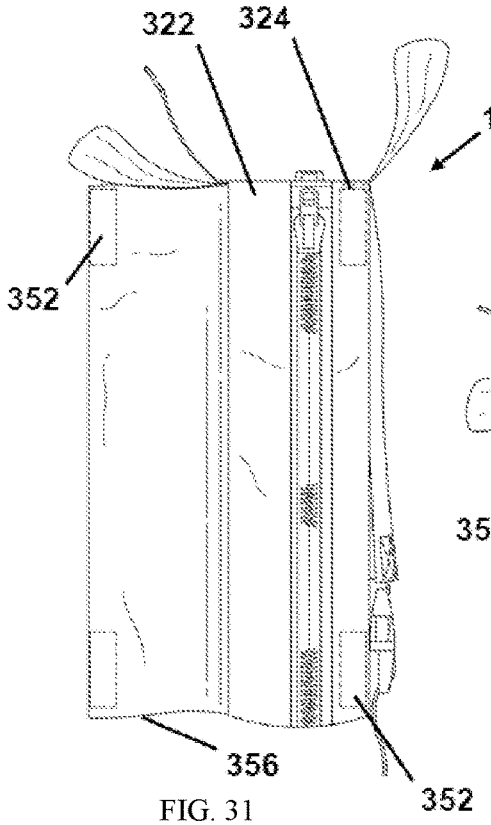
FIG. 31 is a side view of the shoulder bag of FIG. 26.
Figure 32:
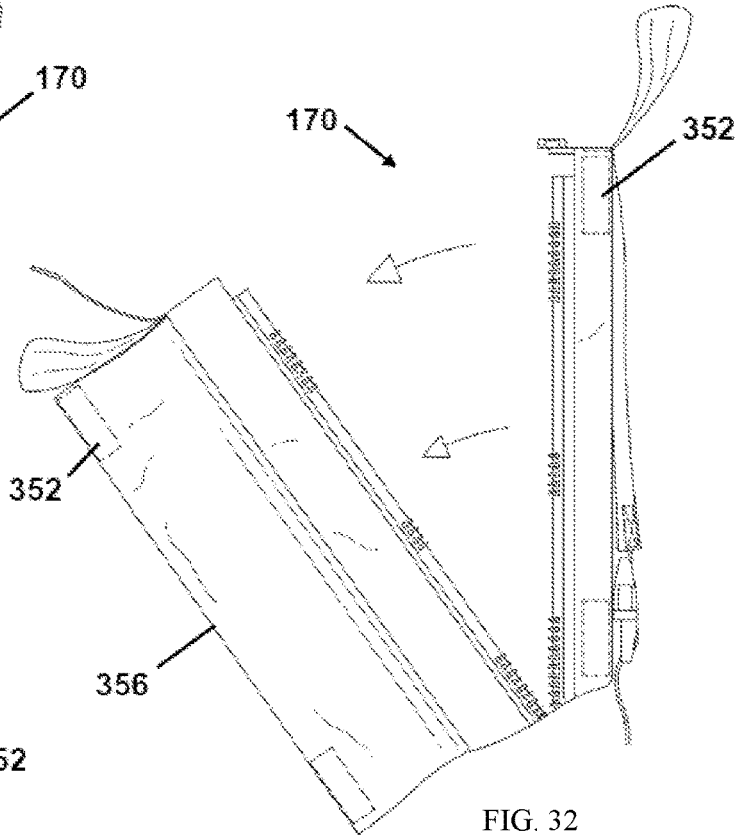
FIG. 32 is another side view of the shoulder bag of FIG. 26.

FIG. 26 show a version of a hand-held or shoulder held QR bag 170 in an open position. With reference to FIGS. 26-34, the QR bag 170 includes a front panel 320, a back panel 340 opposite to the front panel 320, a sub-top wall 322 extending from a top edge of the front panel 320, a sub-top wall 342 extending from a top edge of the back panel 340, opposite sub-lateral walls 324 and 326 extending respectively from each of the lateral sides of the front panel 320, opposite sub-lateral walls extending from each of the lateral sides of the back panel 340, and a bottom wall 325 extending from the bottom side of the front panel 320 to the bottom side of the back panel 340.

When joined together by attachment means, such as a zipper, buttons, the sub-top walls 322 and 342 form top wall 332, the sub-lateral walls 324 and 344 form first lateral wall 334, and sub-lateral walls 326 and 346 form second lateral wall 336.

In the version shown in FIG. 26, to form the complete lateral walls 334 and 336, a conventional zipper tape 328 is secured to each of the sub-lateral walls 324, 326, 344 and 346 in such a manner that movement of the sliding zipper elements 303 opens and closes the lateral sides of the bag 17. The zipper tape 328 extend along the sub-lateral, but they do not reach the top sub-wall 322, 342, thereby leaving openings 330*a,b* when the zipper is in a closed position. Another zipper tape 329, may also be optionally secured to the top sub-walls 322, 342. The zipper tape 329 extends from the first opening 330*a* to the second opening 330*b*.

The panels 320, 340, the side walls 334 and the bottom wall 325 define an interior 302 of the bag 170. The interior includes the interior surfaces 304 of panels 320, 340.

The front panel 320 includes a top flap 350 that extends from a top side of the front panel 320 and overlaps the sub-top walls 322 and 342. The top flap 350 may include one more magnets 352 that cooperate with one or more magnets 352 located on the sub-top wall 342 thereby closing the top side of the bag 170. The top flap 350 may include an opening 354 which that allows the grip portion 9 to slide through.

The front panel 320 may also include lateral flaps 356 that extend from a lateral side of the front panel 320 and overlaps the sub-lateral walls 324, 344 and the sub-lateral walls 326 and 346. The lateral flaps 356 may include one more magnets 352 that cooperate with one or more magnets located on the sub-lateral wall 344 and 346 thereby closing the lateral sides of the QR bag 170.

As shown in FIG. 26, two mounting panels 1 are secured to a mounting surface 304 on the interior 302 of the QR bag 170. One mounting panel instead of two or more may also be used. The strap portions 10 of the quick-release strap 5 may be passed through the channels 7 of the panel loops 6, as described above, to secure a rifle 362 in place. The grip portion 9 may be slidably attached to the intermediate portion 11 of the quick-release strap 5 by way of loops 18. The grip portion 9 may thereby be positioned to serve as a handle for the bag 170, as shown in FIG. 26, by passing through the opening 354 in the top flap 350.

The QR bag 170 can be adapted to be suspended from a shoulder of a user by means of a strap 360 engaging opposed ends of the rifle 362 being kept inside the QR bag 170. The strap 360 can be passed through openings 330*a,b*.

Figure 33:
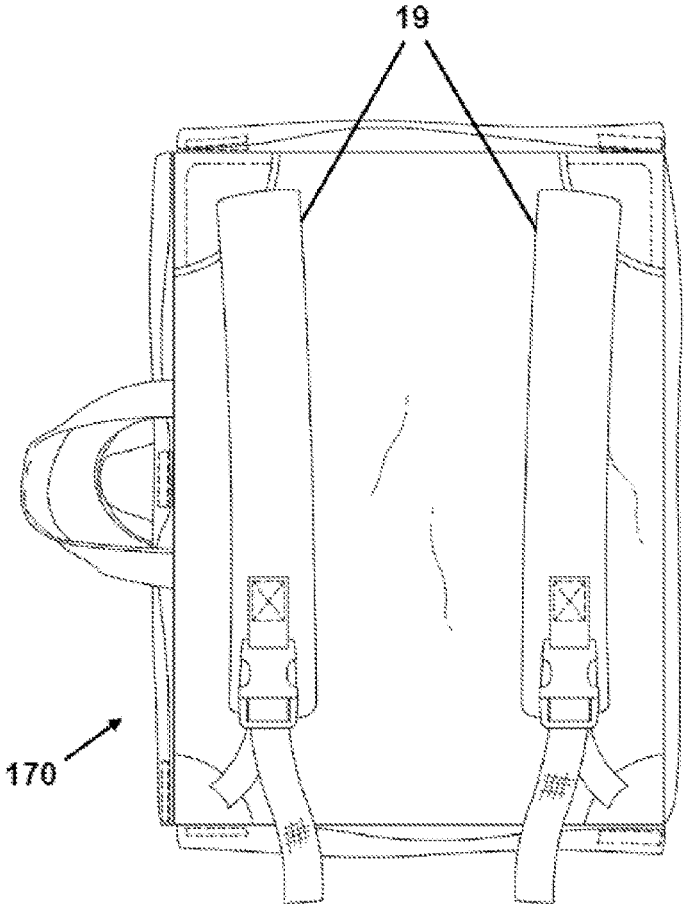
FIG. 33 is rear view of the shoulder bag of FIG. 26, showing backpack style straps.
Figure 34:
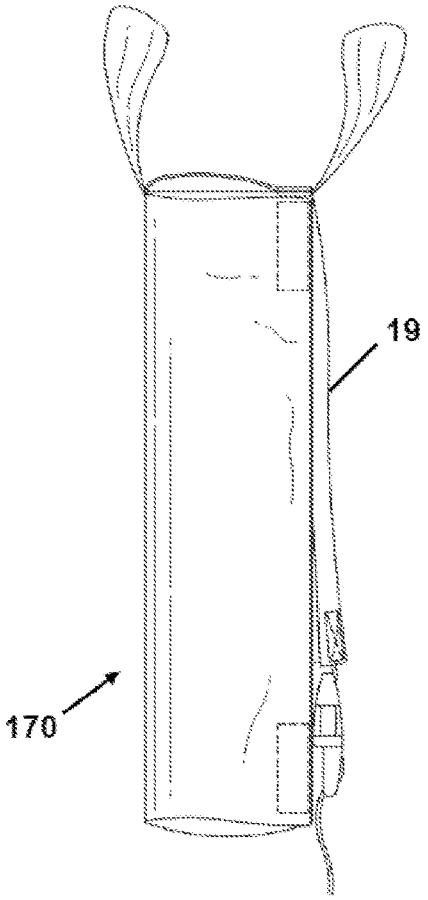
FIG. 34 is a side view of the shoulder bag of FIG. 26.
Figure 35A:
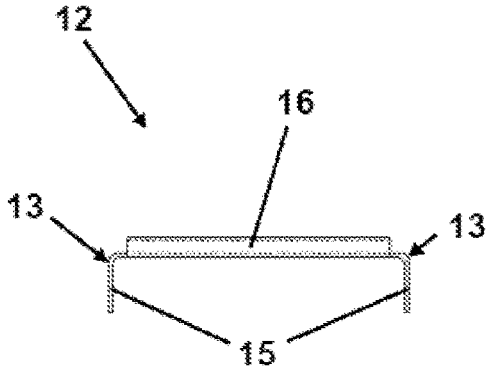
FIG. 35A is an end view of a channel insert, according to the present invention.
Figure 35B:
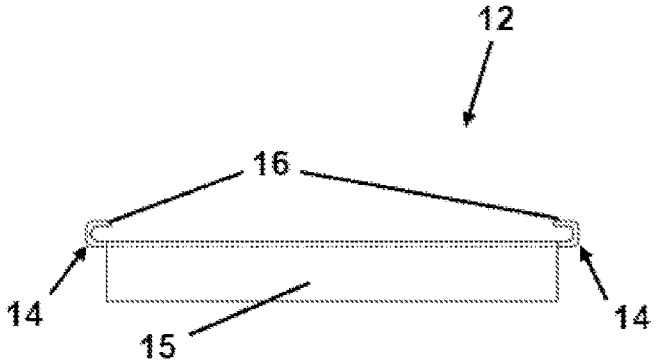
FIG. 35B is a side view of the channel insert shown in FIG. 35A.
Figure 35C:
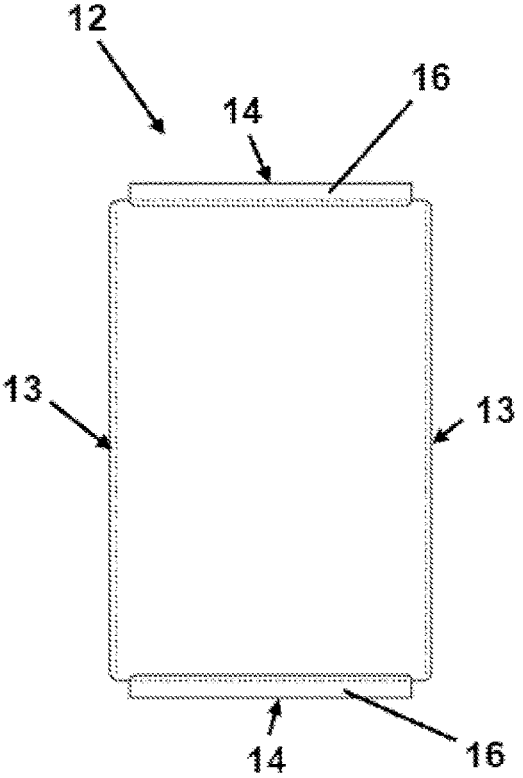
FIG. 35C is a top view of the channel insert shown in FIG. 35A.
Figure 35D:
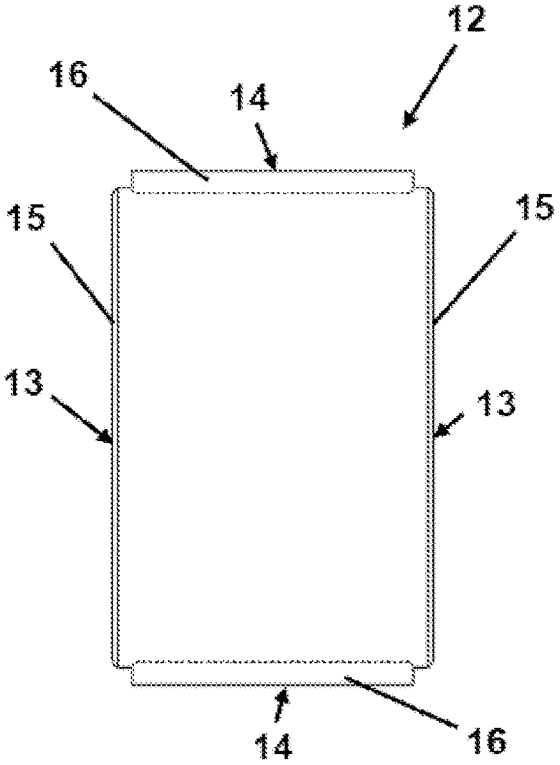
FIG. 35D is a bottom view of the channel insert shown in FIG. 35A.

Optionally, as shown in FIGS. 33 and 34, the rear of the bag 170 may be provided with backpack-style straps 19 to permit the shoulder bag 170 to be worn like a backpack.

To quickly release the rifle 362, the sub-lateral walls and sub-top walls are kept unzipped, and only the flaps 350 and 356 are used to create the interior 302 of the bag 170. That is, the bag 170 is a closed positon using only the magnetic force of the magnets 352. An operator performs the quick-release operation by simply grasping and pulling the grip portion 9 of the quick-release strap 5 to overcome the magnetic force of magnets 352 and quickly release the rifle 362 from its secured position on the mounting surface. The pulling forces act to separate the top and lateral flaps as well as the ends of the strap portions 10, which are wrapped around the rifle 362, and remove the strap portions 10 from the channels 7, thereby releasing the rifle 362.

Securing the Firearm

Unless a mounting panel 1 is permanently attached to the interior of the bag, the mounting panel 1 is secured to the interior 302 of a bag 17, 170. With reference to FIGS. 10, 11, 19, 20 and 21, the strap portions 10 are passed or thread through the channels 7 on the front side 3 of the mounting panel 1.

The firearm is then positioned against the front side 3 of the one or more mounting panels 1. The free ends 104 of the strap portions 10 may be threaded through or passed through the suitable channels 7, are wound around the firearm, and releasably attached to the first ends 103 of the strap portions 10 thereby securing the firearm within the interior 302 of the bag.

Figure 19:
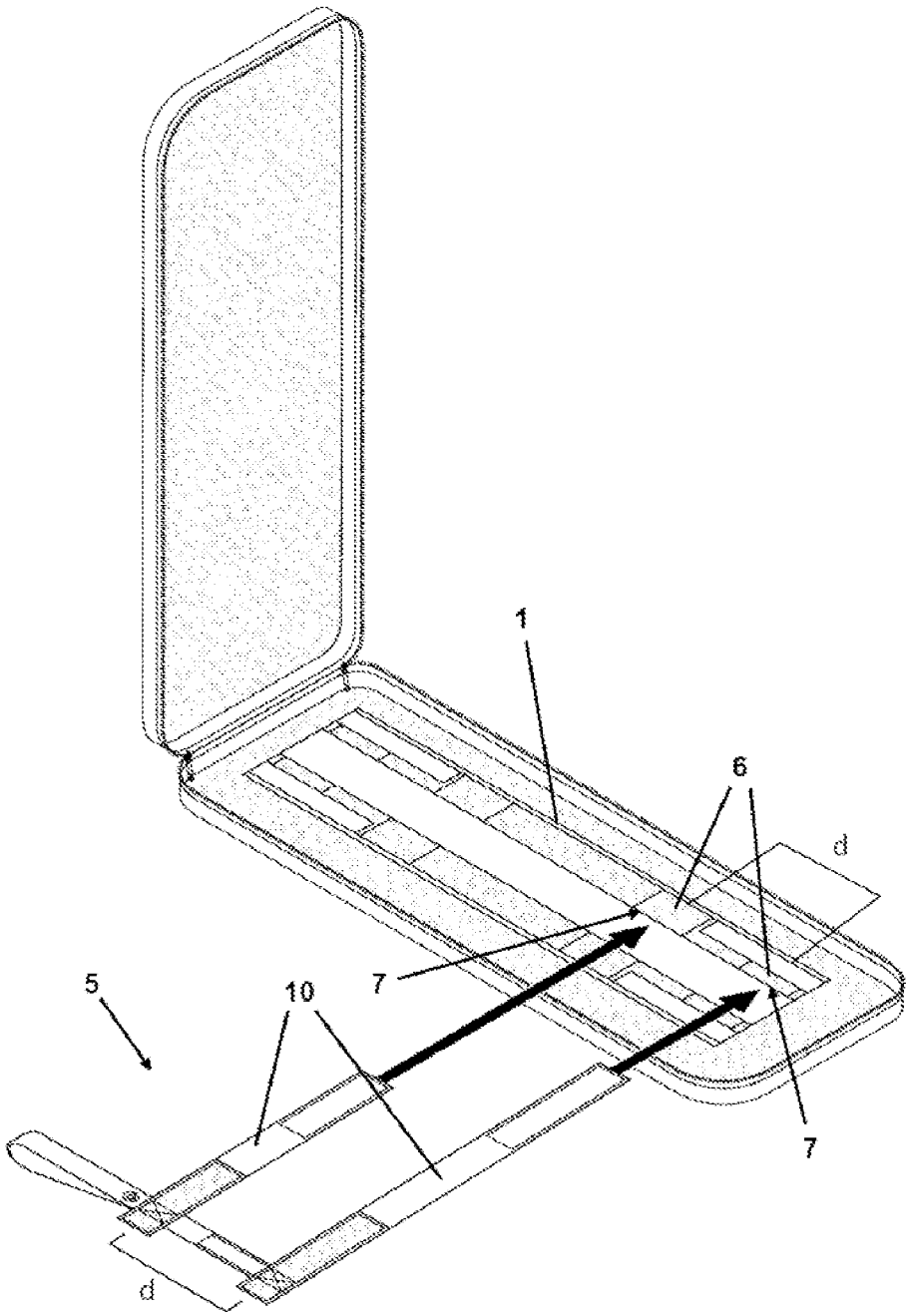
FIG. 19 is a perspective view of the quick-release mounting system, according to the present invention, showing the strap portions of the quick-release strap passing through the channels on the mounting panel.
Figure 20:
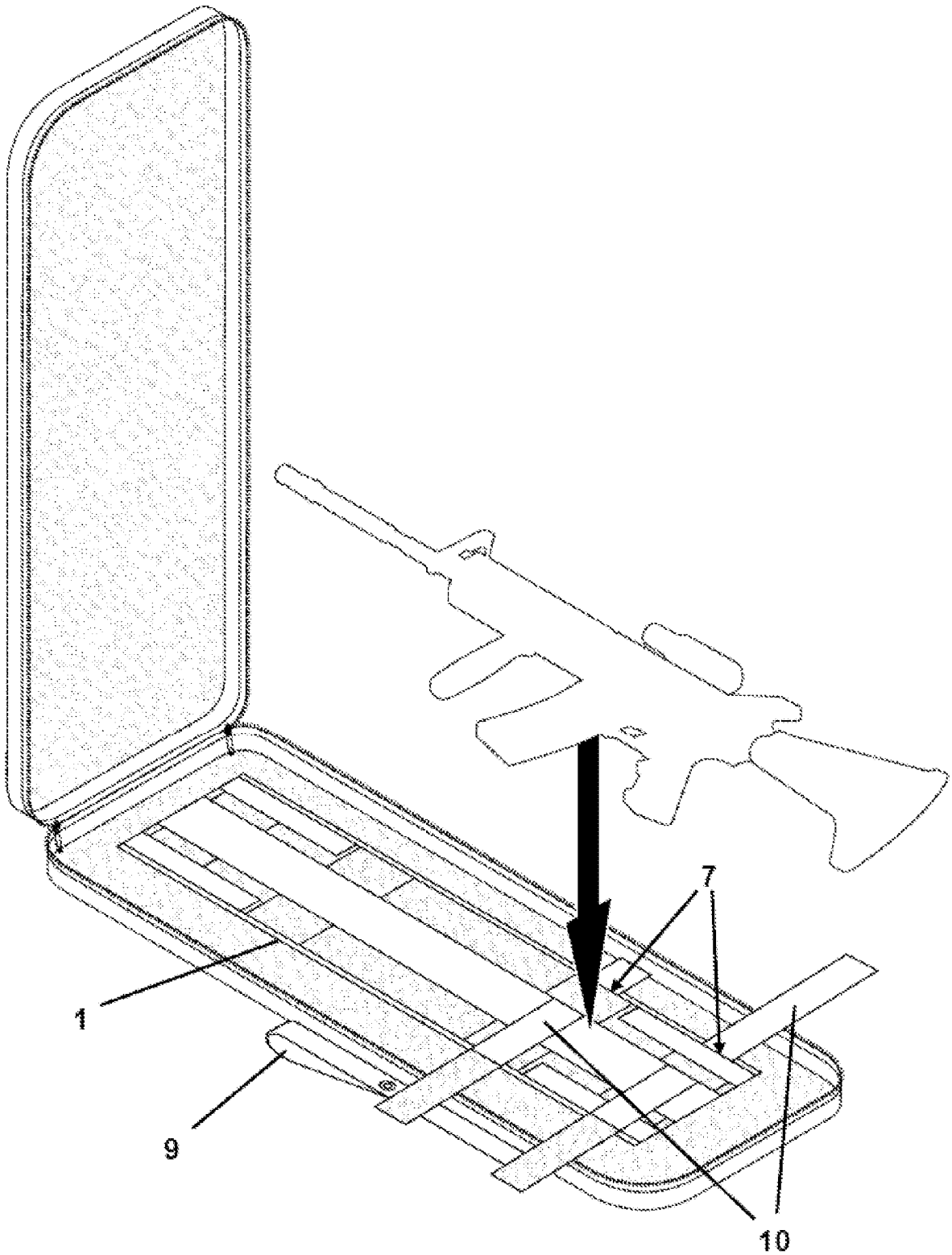
FIG. 20 is a perspective view of the quick-release mounting system, showing a rifle being positioned against the mounting panel.

The distance by which the straps portions 10 and panel loops 6 are spaced apart is equal to the distance between the desired securement points on the firearm to be secured to the mounting surface. For example, as shown in FIGS. 19 and 20 with an AR-series rifle, the preferred attachment points are in front of the pistol grip and in front of the magwell housing. With other firearms, such as a shotgun, the preferred attachment points are in front of the pistol grip and in front of the receiver. Accordingly, when the rifle is positioned against the front side 3 of the mounting panel 1, the securement points on the rifle align with the panel loops 6. The free ends 104 of each of the strap portions 10 may then be passed through the corresponding channel 7, wound around the main receiver and barrel or forward rail of the rifle, and releasably attached to their respective opposing ends, to thereby secure the rifle against the mounting panel 1, on the mounting surface of the bag 17, 170. The grip portion 9 may then be passed through the opening 354 and the bag 17, 170 closed.

Quick Release of the Firearm

To remove the firearm, such as a rifle, an operator performs the quick-release operation by simply grasping and pulling the grip portion 9 of the quick-release strap 5 to quickly release the rifle from its secured position on the mounting surface. The pulling forces act to separate the one or more magnets 352 that were keeping the bag closed, and separate the ends of the strap portions 10, which are wrapped around the rifle, and remove the strap portions 10 from the channels 7, thereby releasing the rifle from the mounting panel 1 and the bag 17, 170.

Optionally, channel inserts 12 may be placed under the panel loops 6, between the front side 3 of the mounting panel 1 and the strip of webbing 8. As shown in FIGS. 35A-D, the channel inserts 12 are rigid, generally sheet-like structures with two opposing sides 13 and two opposing ends 14. Two spacers 15 extend downwardly from the sides 13 of the channel insert 12. The spacers 15 are spaced apart by a distance less than the width of the channel 7 and greater than the width of the strap portions 10, to permit the strap portions 10 to pass there between. Preferably, the spacers 15 extend along the full length of the sides 13. Two retaining edges 16 extend upwardly from the ends 14 of the channel insert 12. The retaining edges 16 engage with the panel loop 6, on either side of the strip of webbing 8, to prevent the channel insert 12 from being inadvertently dislodged from the channel 7.

When placed within the channel 7, the spacers 15 of the channel insert 12 engage with the front side 3 of the mounting panel 1, spacing the channel insert 12 apart therefrom. The channel inserts 12 thereby raises the strip of webbing 8, creating a space within the channel 7 between the panel loop 6 and the front side 3 to prevent binding or snagging of the strap portions 10 therein. Preferably, the downwardly facing surface of the channel insert 12 and inwardly facing surfaces of the spacers 15 are smooth, or otherwise configured to reduce friction with the quick-release strap 5, when the strap portions 10 are removed from the channels 7, during the quick-release operation.

Optionally, a barrel stabilizer (not shown) may be provided to prevent the barrel of the rifle from moving around within the backpack and potentially damaging the other contents of the backpack. Preferably, the barrel stabilizer is a strap that may be threaded through a channel 7 on the lower portion of the mounting panel 1 and wound around the end of the barrel of the rifle. The barrel stabilizer may be sized to accommodate various attachments on the barrel, such as a suppressor.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A quick-release firearm mounting system, comprising: (a) one or more mounting panels, each mounting panel including a back side and a front side opposite to the back side, the back side having means for securely engaging to an interior surface of a bag, and the front side having one or more panel loops extending therefrom, whereby each panel loop forms an open channel between the panel loop and the front side of the mounting panel; and (b) a quick-release strap to secure a firearm to the one or more mounting panels, the quick-release strap having a grip portion and two strap portions, each strap portion having a first end attached to the grip portion such as leaving a free end on the grip portion, and a second free end sized to be threaded through the channels on the front side of the mounting panel and wrapped around the firearm, the first and second ends of each strap portion having means for releasably attaching the first end and second end to form strap loops to secure the firearm to the one or more mounting panels, the quick-release strap being configured such that when the quick-release strap secures the fire arm to the one or more mounting panels, pulling forces acting on the free end of the grip portion releases the firearm from the quick-release firearm mounting system.

2. The quick-release firearm mounting system of claim 1, wherein each mounting panel further includes one or more strips of webbing attached to the front side at multiple locations, and wherein the one or more panel loops are defined between the points of attachment of the strips of webbing at the multiple locations.

3. The quick-release firearm mounting system of claim 1, wherein the free end of the grip portion has a loop handle to facilitate gripping the grip portion and pulling from the free end.

4. The quick-release firearm mounting system of claim 1, wherein the quick release strap further includes a link strap releasably coupled to the grip portion, the link strap having adjustable means to manipulate the length of the quick-release strap.

5. The quick-release firearm mounting system of claim 1, wherein the system further comprises the bag.

6. The quick-release firearm mounting system of claim 5, wherein the bag comprises a front panel, a back panel opposite to the front panel, a first top wall portion extending from a top edge of the front panel, a second top wall portion extending from a top edge of the back panel, first lateral walls extending from lateral sides of the front panel, second lateral walls extending from lateral sides of the back panel, and a bottom wall extending from a bottom side of the front panel to a bottom side of the back panel, the first top wall portion being adapted to connect with the second top wall portion to form a top wall and the first lateral walls being adapted to connect with the second lateral walls to form side walls, the front panel, back panel, the top wall, the side walls and the bottom wall define a bag interior which includes an interior surface adapted for engaging with the back side of the mounting panel.

7. The quick-release firearm mounting system of claim 6, wherein the bag further comprises a top flap that extends from a top side of the front panel, the top flap being sized to overlap the top wall, the top flap having a top flap opening that aligns with a top wall opening that allows the grip portion to slide through such that the grip portion serves as a handle for the bag.

8. The quick-release firearm mounting system of claim 7, wherein the top flap includes one or more magnets that cooperate with corresponding one or more magnets located on the first top wall portion or the second top wall portion to close the top wall of the bag.

9. The quick-release firearm mounting system of claim 7, wherein the bag further comprises lateral flaps extending from the lateral sides of the front panel and that overlap the first and second lateral walls.

10. The quick-release firearm mounting system of claim 9, wherein the lateral flaps include one or more magnets that cooperate with corresponding one or more magnets on the lateral walls.

11. The quick-release firearm system of claim 6, further comprising the firearm and wherein the strap portions of the quick-release strap are threaded through the channels and the rifle is positioned against the front side of the mounting panel and the strap loops around the firearm, thereby releasably securing the firearm in the bag.

* * * * *